US009613774B2

(12) United States Patent
Gates et al.

(10) Patent No.: US 9,613,774 B2
(45) Date of Patent: Apr. 4, 2017

(54) CIRCUIT BREAKERS WITH COMMON TRIP CAMS AND RELATED TRIP CAMS

(71) Applicant: Eaton Corporation, Cleveland, OH (US)

(72) Inventors: Daniel Quentin Gates, Hoboken, NJ (US); Jeffrey Scott Gibson, Hookstown, PA (US)

(73) Assignee: Eaton Corporation, Cleveland, OH (US)

( * ) Notice: Subject to any disclaimer, the term of this patent is extended or adjusted under 35 U.S.C. 154(b) by 222 days.

(21) Appl. No.: 14/575,426

(22) Filed: Dec. 18, 2014

(65) Prior Publication Data

US 2016/0181045 A1 Jun. 23, 2016

(51) Int. Cl.

| | |
|---|---|
| ***H01H 3/20*** | (2006.01) |
| ***H01H 71/52*** | (2006.01) |
| ***H01H 71/10*** | (2006.01) |
| *H01H 69/01* | (2006.01) |
| *H01H 71/04* | (2006.01) |

(52) U.S. Cl.

CPC ..... *H01H 71/522* (2013.01); *H01H 71/1027* (2013.01); *H01H 69/01* (2013.01); *H01H 71/04* (2013.01)

(58) Field of Classification Search

CPC ..... H01H 71/10; H01H 69/01; H01H 71/02; H01H 2069/016; H01H 2205/002; H01H 71/522; H01H 71/1027; H01H 71/04

USPC ..... 200/330

See application file for complete search history.

(56) References Cited

U.S. PATENT DOCUMENTS

| | | | | |
|---|---|---|---|---|
| 3,646,487 | A * | 2/1972 | Brackett, Sr. | H01H 71/1027 335/8 |
| 5,131,504 | A | 7/1992 | Yoo et al. | |
| 5,898,146 | A | 4/1999 | Beck et al. | |
| 6,323,748 | B1 * | 11/2001 | Malingowski | H01H 3/04 335/172 |
| 6,917,267 | B2 | 7/2005 | Lias et al. | |
| 7,368,677 | B2 | 5/2008 | Jones et al. | |
| 7,598,467 | B2 | 10/2009 | Gibson et al. | |
| 8,217,287 | B2 | 7/2012 | Kil | |
| 8,222,983 | B2 | 7/2012 | Zhou et al. | |
| 9,343,256 | B1 * | 5/2016 | Gibson | H01H 71/04 |
| 2016/0163479 | A1 | 6/2016 | Gibson | |

* cited by examiner

*Primary Examiner* — Felix O Figueroa
*Assistant Examiner* — Lheiren Mae A Caroc
(74) *Attorney, Agent, or Firm* — Myers Bigel, P.A.

(57) ABSTRACT

Circuit breakers with handles have common trip cams with an integrated spring and trip cam base. The integrated spring directly contacts the armature in lieu of having the trip cam base formed to do so thereby allowing the use of alternative trip cam base configurations and materials from conventional relatively expensive materials.

19 Claims, 22 Drawing Sheets

CIRCUIT BREAKERS WITH COMMON TRIP CAMS AND RELATED TRIP CAMS

FIELD OF THE INVENTION

The present invention relates to circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a typical circuit breaker, current enters the system from a power line and passes through a line conductor to a stationary contact fixed on the line conductor, then to a movable contact. The movable contact is fixedly attached to a pivoting arm. As long as the stationary and movable contacts are in physical contact, current passes from the stationary contact to the movable contact and out of the circuit breaker to down-line electrical devices.

In the event of an overcurrent condition (short circuit or extended conducting time greater than device rated current), the device responds by "tripping". The armature will disengage the cradle allowing it to rotate to a second position. This position reorients the breaker mechanism and stored energy of the mechanism spring to (1) compel the device operating handle to move to a secondary position and (2) separate the contacts in order to stop the flow of electrical current.

As is well known to those of skill in the art, common trip cams provide a mechanical link between poles of a breaker to ensure all poles trip when one of them trips. Traditionally, common trip cams that are used in high rated miniature circuits breakers (70 A and above) are made of relatively expensive materials that prevent the cam from melting when in contact with the armature. The material is also flexible to account for pole to pole tolerance variations and calibration differences that may otherwise defeat the common trip function. FIG. 1 is an example of a prior art common trip cam.

SUMMARY OF EMBODIMENTS OF THE INVENTION

Embodiments of the present invention are directed to common trip cams for circuit breakers with a base and a spring held by the base.

Embodiments of the invention are directed to circuit breakers that include a housing; a pivotable handle held by a respective housing; a moving contact arm held in a respective housing in communication with the handle; and a trip cam held in a respective housing, the trip cam comprising at least one spring extending outward from an axis of rotation of the trip cam. The breakers can also include a cradle in the housing in communication with the handle and the trip cam.

The at least one spring can be held by a trip cam base. The at least one spring can have at least one segment extending outward from the trip cam base.

The circuit breaker can include an armature in the housing. The at least one segment of the spring includes a leg sized and configured to reside proximate the armature.

The trip cam base can have opposing circular end segments separated by a neck segment, and wherein the at least one spring has a straight segment extending across the neck segment and at least one arcuate segment that travels about at least a portion of a respective circular end segment before merging into the at least one segment that extends outward from the trip cam base.

The trip cam base can have opposing circular end segments separated by a neck segment and an arm that extends away from the neck segment. The arm can cooperate with an operator mechanism in the housing to force the trip cam base to turn when the breaker trips. At least one of the circular end segments may include an open slot sized and configured to receive a link member for linking another trip cam of an adjacent pole of the circuit breaker.

The at least one spring segment can be a leg that can flex and has a free end, wherein the leg can flex side-to-side and/or front-to-back to accommodate tolerance variations.

The at least one spring segment that extends outward can include first and second spaced apart segments that extend outward, the first segment can be a leg and the second segment can be an arm. The arm can resides closer to the handle than the leg. The leg can have a longer length than the arm.

The at least one spring can be a single, continuous length wire with a preformed shape. The preformed shape may have straight segment with opposing first and second ends, the first end of the straight segment merging into a first arcuate segment that merges into the leg, the second end of the straight segment merging into a second arcuate segment that merges into the arm.

The at least one segment of the spring that extends outward can include a leg that has a primary portion that is straight that merges into a free end portion that extends substantially orthogonal to the primary portion of the leg. The leg can be configured to be able to flex side to side and/or front to back relative to the trip cam base to engage an armature in the circuit breaker.

The at least one segment of the spring that extends outward can include a leg that directly contacts an armature of the circuit breaker and an arm that directly contacts the handle.

The first arcuate segment can extend about a first circular end segment of the trip base a first angular distance. The second arcuate segment can extend about a second axially spaced apart circular end segment of the trip base a second angular distance. The second angular distance can be greater than the first angular distance.

The housing can be configured as a plurality of adjacent housings forming multiple poles of the circuit breaker, each having a respective handle, moving contact arm and trip cam. The trip cams can each have a trip cam base with at least one spring and opposing circular end segments. Adjacent circular end segments of neighboring housings are mechanically linked together so that when one pole of the circuit breaker trips a respective trip cam of that pole, the trip cam of that pole forces other linked trip cams to rotate so that all poles trip to thereby have a common trip function.

The trip cam base can have opposing circular end segments, at least one of the circular end segments can include an open slot sized and configured to receive a link member for linking another trip cam of an adjacent pole of the circuit breaker. At least one of the circular end segments can include a groove in an outer surface thereof that holds a segment of the at least one spring in position.

Other embodiments are directed to trip cams for a circuit breaker. The trip cams can include a trip cam base having a neck separating a first end portion and a second end portion. The second end portion defining an arm that is sized and configured to cooperate with an operator mechanism to force the trip cam to turn when a circuit breaker trips. The trip cams can also include at least one spring held on the trip cam base defining a leg segment that extends off the trip cam base a distance sufficient to contact an armature in a circuit breaker.

The leg can have a primary portion that is straight that merges into a free end portion that extends substantially orthogonal to the primary portion of the leg. The leg can be configured to be able to flex side to side and/or front to back relative to the trip cam base to engage an armature in the circuit breaker. The leg can have a length that is between about ⅜ inch and about ¾ inch but other lengths may be suitable.

The trip cam base can have opposing circular end segments separated by the neck segment. The at least one spring can have a straight segment extending across the neck segment and at least one arcuate segment that travels about at least a portion of a respective circular end segment before merging into the leg.

The trip cam base can have opposing circular end segments separated by the neck segment. At least one of the circular end segments can include an open slot sized and configured to receive a link member for linking another trip cam of an adjacent pole of the circuit breaker.

The trip cam base can have opposing circular first and second end segments separated by a neck segment. The at least one spring can include an arm that is spaced apart from the leg to reside adjacent the first end segment of the trip cam base and the leg resides adjacent the second end segment of the trip cam base, and wherein the leg has a longer length than the arm.

The at least one spring can be a single, continuous length wire with a preformed shape comprising a straight segment with opposing first and second ends. The first end of the straight segment can merge into the leg, the second end of the straight segment can merge into a second arcuate segment that can merge into an arm.

The first arcuate segment can extend about a first circular end segment of the trip base a first angular distance. The second arcuate segment can extend about a second axially spaced apart circular end segment of the trip base a second angular distance. The second angular distance can be greater than the first angular distance.

Embodiments of the invention also include methods of moving components of a circuit breaker upon a tripping event. The methods include upon a tripping event: automatically rotating a cradle to realign a mechanism pivot point to move a handle from an ON to a TRIPPED position and, simultaneously, the rotating cradle interacts with an arm of a trip cam base to force trip cam rotation, wherein (a) rotation of a trip cam spring leg in response to the forced trip cam rotation applies an additional force on the handle to assist in movement of the handle to the TRIPPED position and (b) rotation of the trip cam produces a likewise rotation of all adjacent trip cams that are linked so that respective trip cam spring legs of linked poles engage a respective armature and forcibly also trip corresponding mechanisms.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
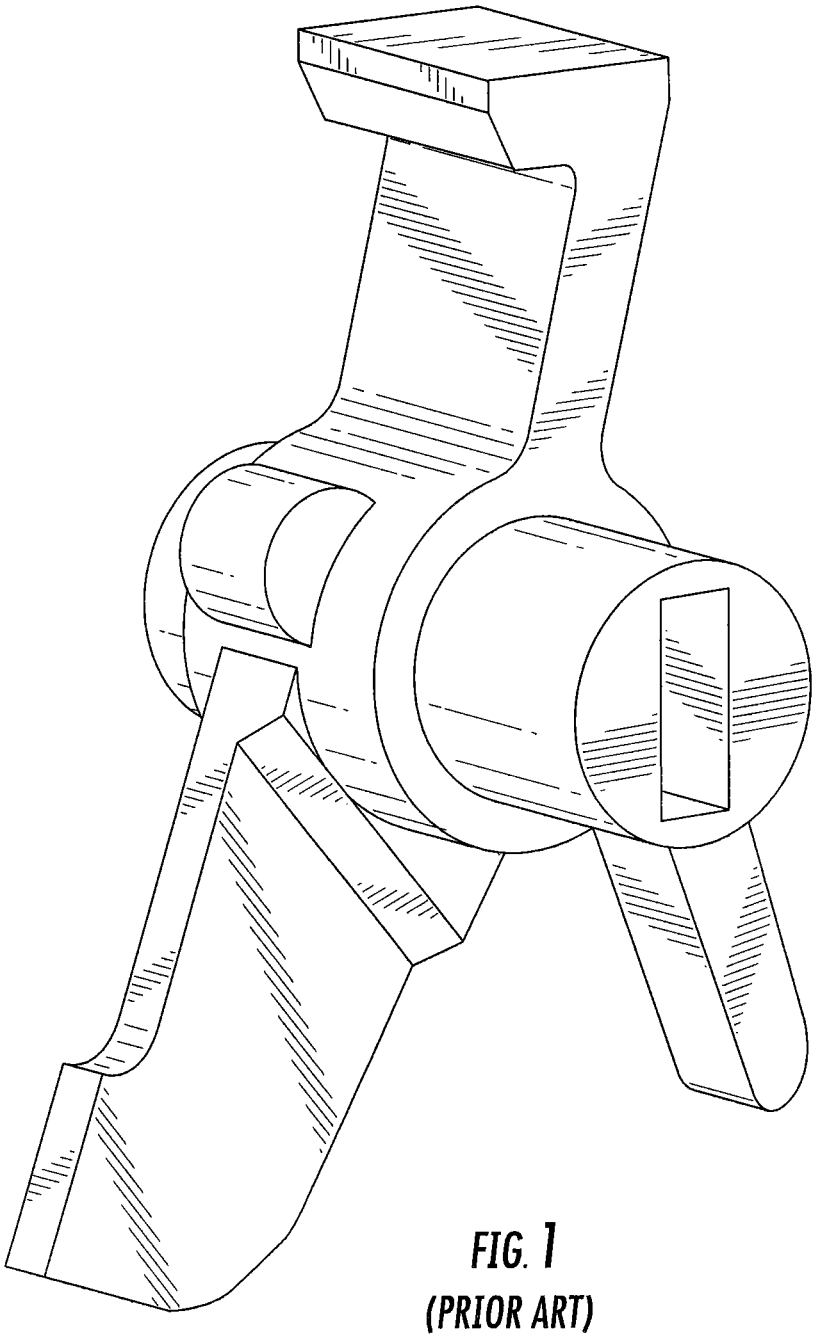
FIG. 1 (PRIOR ART)
FIG. 1 is a greatly enlarged side perspective view of a prior art trip cam.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 40, 40', 40", 40'").

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "bottom", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass orientations of above, below and behind. The device may be otherwise oriented (rotated 90° or at other orientations) and the spatially relative descriptors used herein interpreted accordingly.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "non-ferromagnetic" means that the noted component is substantially free of ferromagnetic materials so as to be suitable for use in the arc chamber (non-disruptive to the magnetic circuit) as will be known to those of skill in the art.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

The handle can be associated with a disconnect operator (e.g., an operating handle) connected to an assembly for opening and closing separable main contacts in a circuit breaker and/or for turning power ON and OFF. The circuit breaker can be for a motor starter unit or feeder unit, for example.

Turning now to the figures, FIGS. 2A, 2B, 3A, 4A and 4B illustrate a trip cam 10 with a trip cam base or body 10*b* and at least one spring 20. The terms "base" and "body" with respect to the trip cam are used interchangeably herein. The at least one spring 20 can be a single shaped spring (FIG. 3A) being able to hold a defined shape at least at defined segments thereof, or may comprise multiple separate springs (FIG. 3B) configured to perform one or more functions shown by way of example in most of the figures. The spring 20 can include at least one leg 21 that is configured to extend out from an axis of rotation of the trip cam (axis A-A, FIGS. 2A/2B) and/or extend from the trip cam body 10*b* a sufficient distance to engage an armature 45 (FIG. 8A) in the circuit breaker 100 when the trip cam body 10*b* is turned. The leg 21 can have an end portion 21*e*, typically a free end portion, that extends at an angle off of the primary leg portion 21*p* to facilitate a suitable engagement with respective armature 45. The end portion 21*e* can extend at a right angle (perpendicular to) the primary portion of the leg 21*p*. The end portion 21*e* can be a self-supported free end portion that can turn to travel a distance toward the trip cam body 10*b*.

The leg 21 can be configured to flex in order to facilitate and/or guarantee necessary trip cam rotation of linked poles to assure the trip, as manufacturing tolerances and/or variations may mandate.

The at least one spring 20 can have any suitable shape for its intended circuit breaker and can vary depending on the trip cam body and/or spacing of the trip cam body from internal cooperating components, such as an armature and/or cradle, for example.

The at least one spring 20 can be shaped and configured to resiliently and/or flexibly "clip" and/or "snap" onto the trip cam base/body 10*b* so as to snugly reside on the trip cam base body 10*b*. Once on the trip cam body 10*b* and in correct position, it is held in place by the geometry and features of the spring 20 and/or trip cam base 10*b*. That is, for example, the straight segment 20*s* of the spring 20 can extend over a neck 10*n* of the trip cam body 10*b* and the two arcuate segments 20*a*, 20*c* then extend about the respective opposing circular end segments 10*c* thus inhibiting longitudinal and radial movement.

Figure 2A:
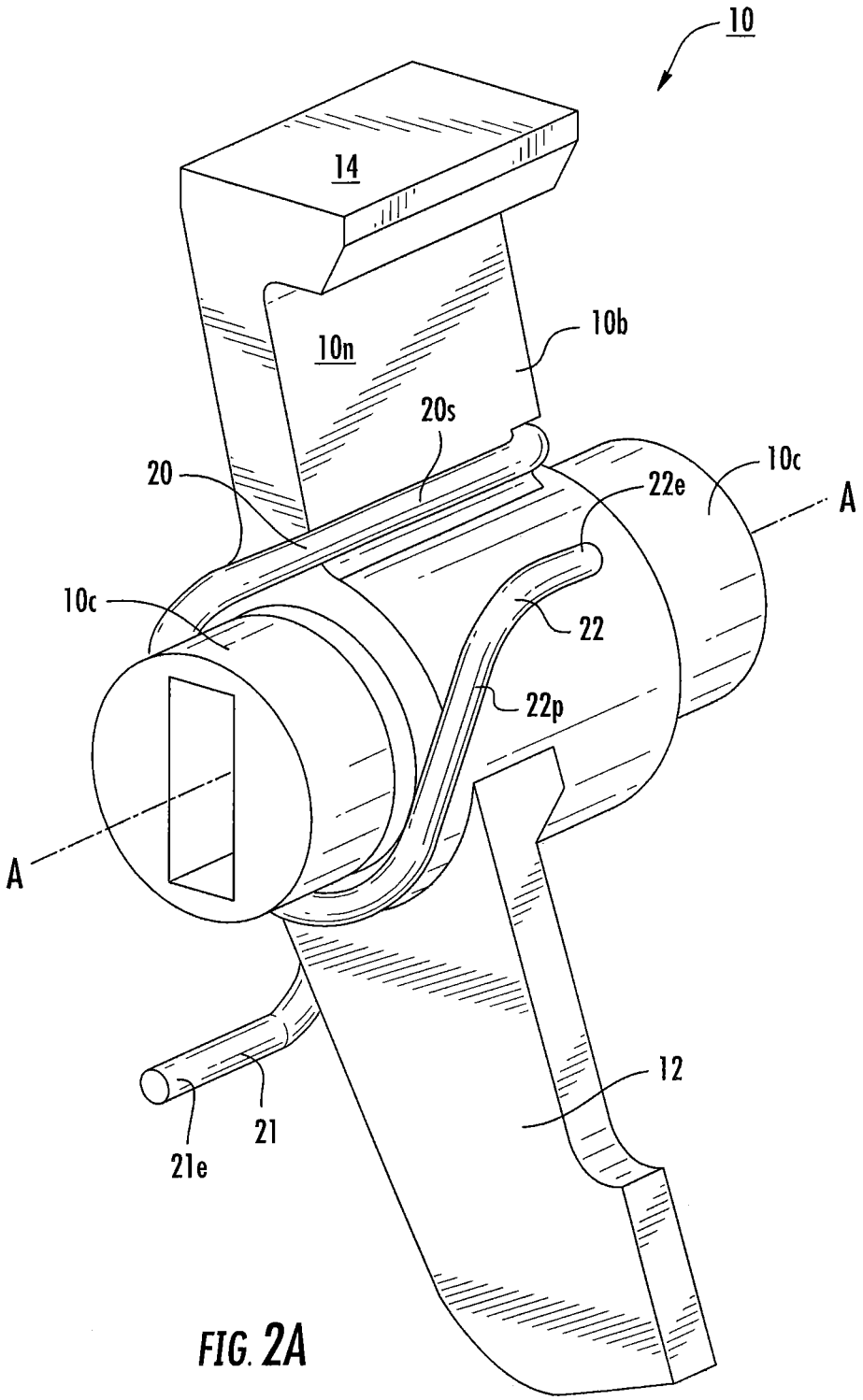
FIG. 2A is a greatly enlarged side perspective view of a trip cam according to embodiments of the present invention.
Figure 2B:
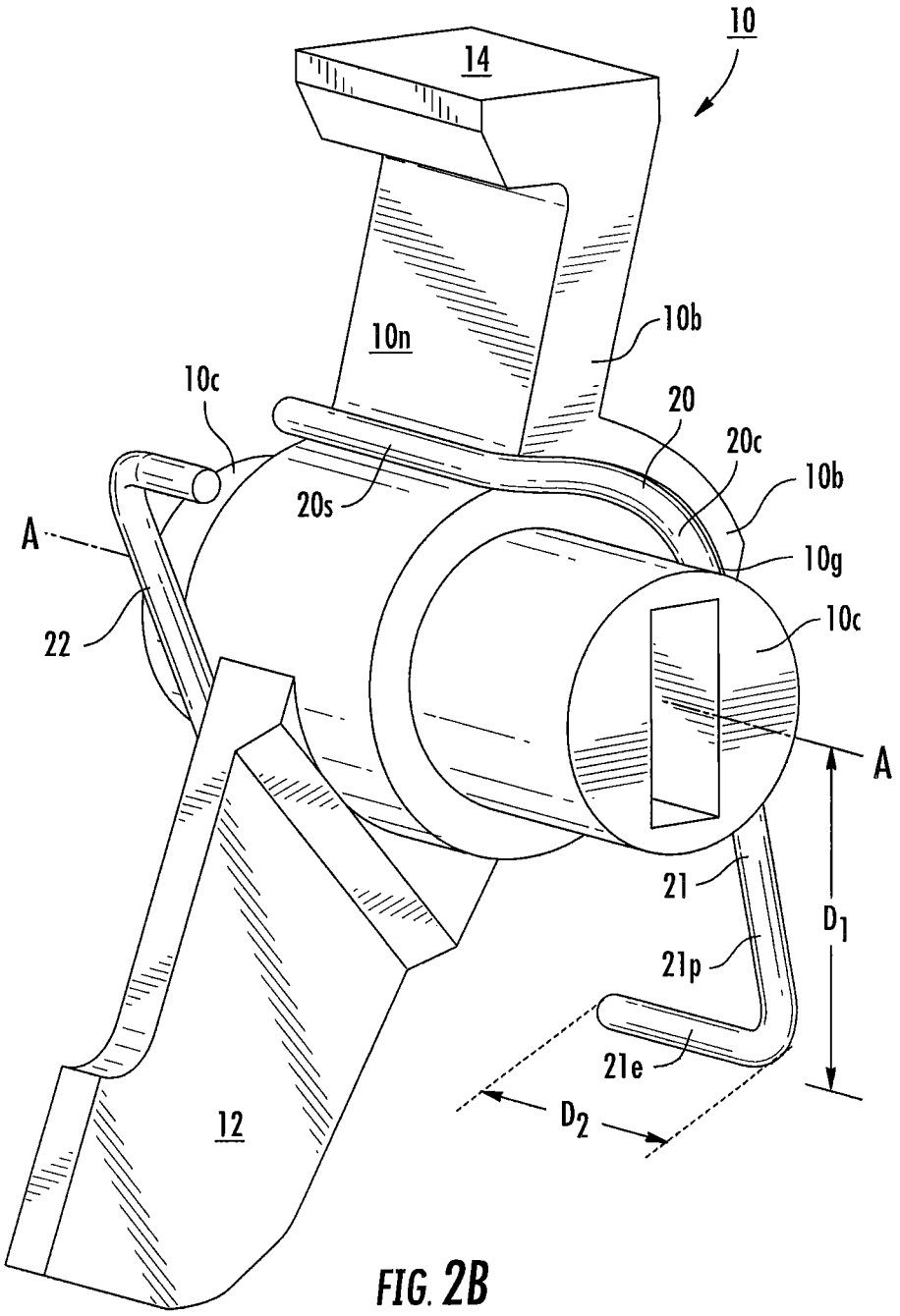
FIG. 2B is a greatly enlarged side perspective view of the trip cam, opposite to that shown in FIG. 2A, according to embodiments of the present invention.

Referring to FIG. 2B, the leg 21 can extend below a pivot axis of the trip cam body 10*b* and/or the axis of rotation A-A of the trip cam 10 by a distance D1. The distance D1 can, in some particular embodiments be between about ⅜ inch to about ¾ inch. The end portion 21*e* can extend a distance D2 to have a length that may be in some embodiments, between about ⅛ inch to about ½ inch. The leg 21 can have a length that is greater than the arm length 22.

The leg 21 can directly contact the armature 45 while the trip base body 10*b* remains spaced apart from the armature 45.

The leg 21 can have a primary portion that is straight for a distance as it extends off the trip cam base 10*b*, then can merge into a free end portion 21*e* that extends substantially orthogonal to the primary portion of the leg. The leg 21 can be configured to be able to flex side-to-side and/or front-to-back relative to the trip cam base 10*b* to engage an armature in the circuit breaker and accommodate manufacturing and/or build tolerances.

The at least one spring 20 can have a body that is a monolithic continuous length, pre-formed and self-supporting shape. That is, as shown in FIG. 3, the spring 20 can have the same shape whether it is mounted to the trip cam base 10*b* or in a pre-attachment state. The at least one spring 20 can comprise a spring temper and/or shape memory material such as music or stainless steel wire, for example. The trip cam body 10*b* can comprise a less expensive material than many prior art trip cams, such as, but not limited to a low cost thermoplastic material such as nylon 66, for example. The spring body can be formed of a wire with a cross-sectional width and/or diameter between about 1/64 inches to about 1/32 inches, typically about 0.025 inches. The spring 20 can have a circular cross-sectional (in a width direction) perimeter shape or may have a polygonal (e.g., square) or other shape.

The at least one spring 20 may also optionally include an arm 22 that extends off the trip cam body 10*b* and resides closer to a front face F of the circuit breaker (closer to the handle 15) than the leg 21. The arm 22 may also have an end portion 22*e* that extends at an angle off the primary portion of the arm 22*p*. The end portion 22*e* can be a self-supporting free end portion and can be configured to bump, push or nudge a handle 15 in a define direction to thereby force the handle to a trip position, typically a bottom portion of the handle 15*b*, when the trip cam body 10*b* is turned (FIG. 8D).

One or both of the ends 21*e*, 22*e* of the arm 22 or leg 22 can include a sleeve or cap to increase the contact force or surface area (not shown). The sleeve and/or cap can be conductive or non-conductive, but if used, preferably can withstand a high temperature environment.

Figure 3A:
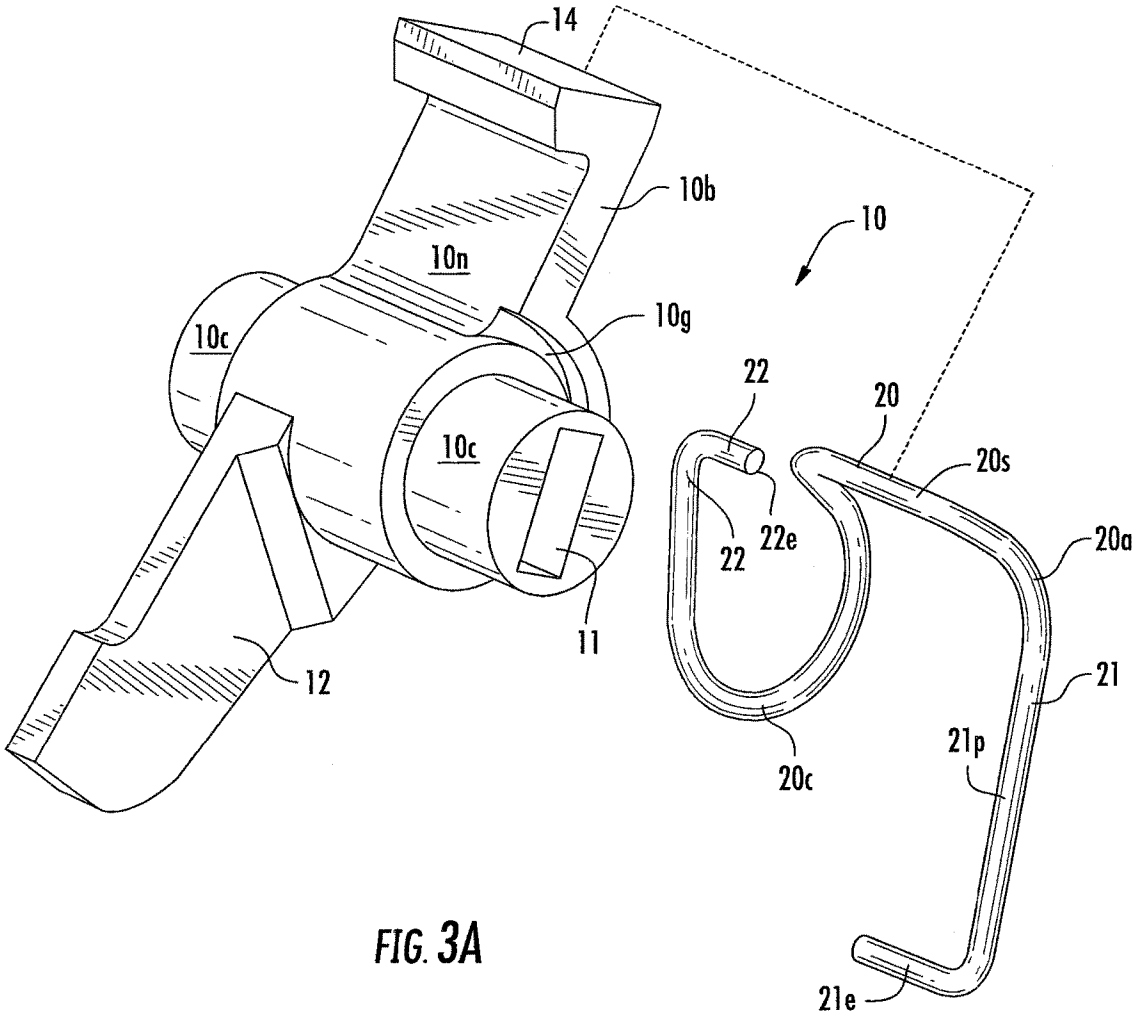
FIG. 3A is an exploded view of the trip cam shown in FIGS. 2A and 2B.

FIG. 3A illustrates that the spring 20 can be configured with a straight segment 20*s* that extends between and connects the leg 21 and arm 22. The spring 20 may also include a first arc segment 20*a* that extends between one side of the straight segment 20*s* and the leg 21. The spring 20 may also include a second arc segment 20*c* that extends between an opposing side of the straight segment 20*s* and the arm 22.

Figure 3B:
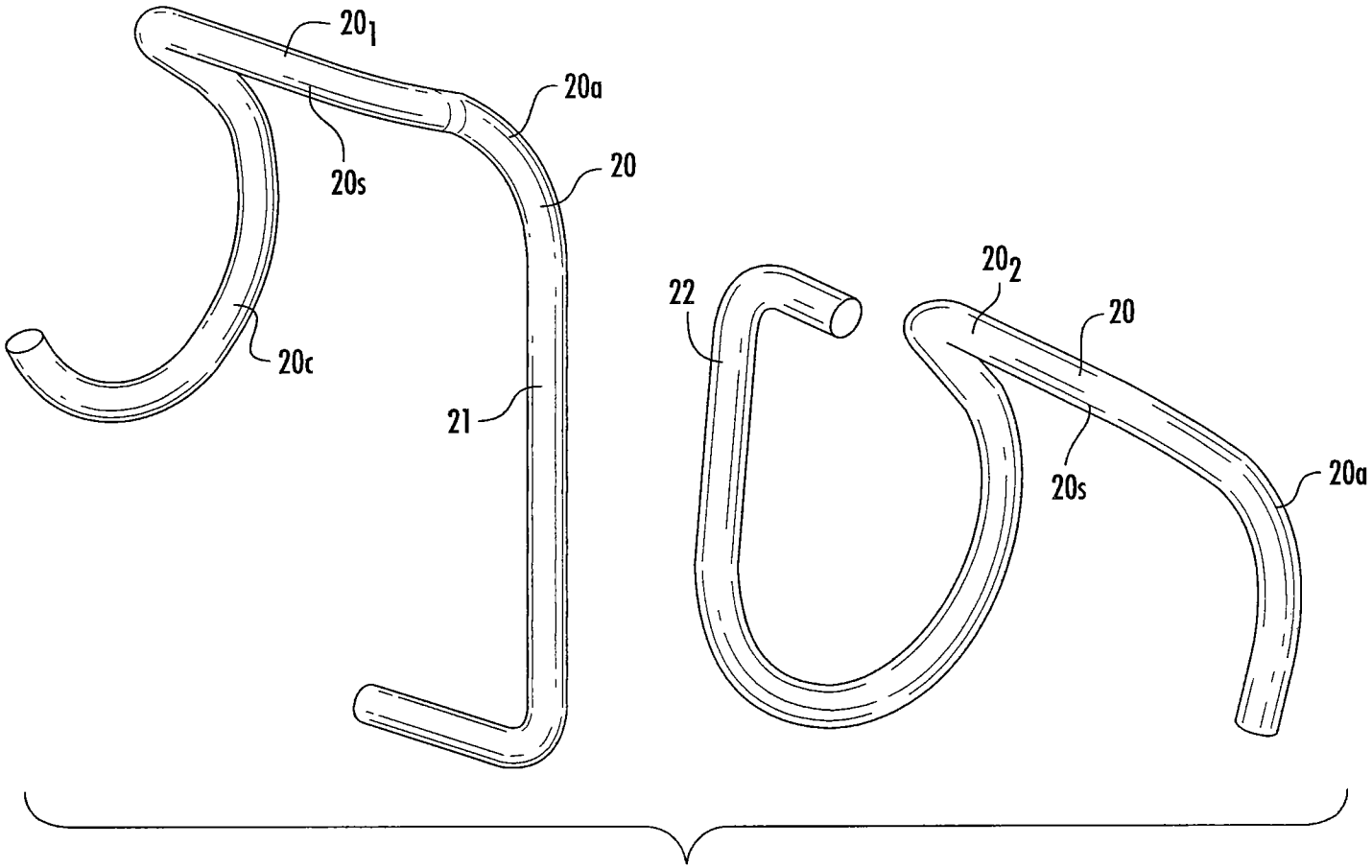
FIG. 3B is an enlarged view of additional examples of trip cam springs according to embodiments of the present invention.

FIG. 3B illustrates examples of other trip cam springs 20, shown as a first spring $\mathbf{20}_1$ with the leg 21 and a second spring $\mathbf{20}_2$ with the arm 22. A respective trip cam base 10 can concurrently hold both springs $\mathbf{20}_1$, $\mathbf{20}_2$. In some embodiments, only a single one of the two springs may be used for a respective trip cam base 10*b*, e.g., only the spring $\mathbf{20}_1$ with the leg 21. Each spring $\mathbf{20}_1$, $\mathbf{20}_2$ can include shaped arcuate segments 20*a*, 20*c* that hold the respective spring in position on the trip cam base 10*b*. Each spring $\mathbf{20}_1$, $\mathbf{20}_2$ can include straight segments 20*s* that extend across the neck of the trip cam base 10*b*. One straight segment 20*s* may reside on one side of the neck 10*n* and one on the other or both can extend across the same side, one above the other (not shown), for example.

Figure 4A:
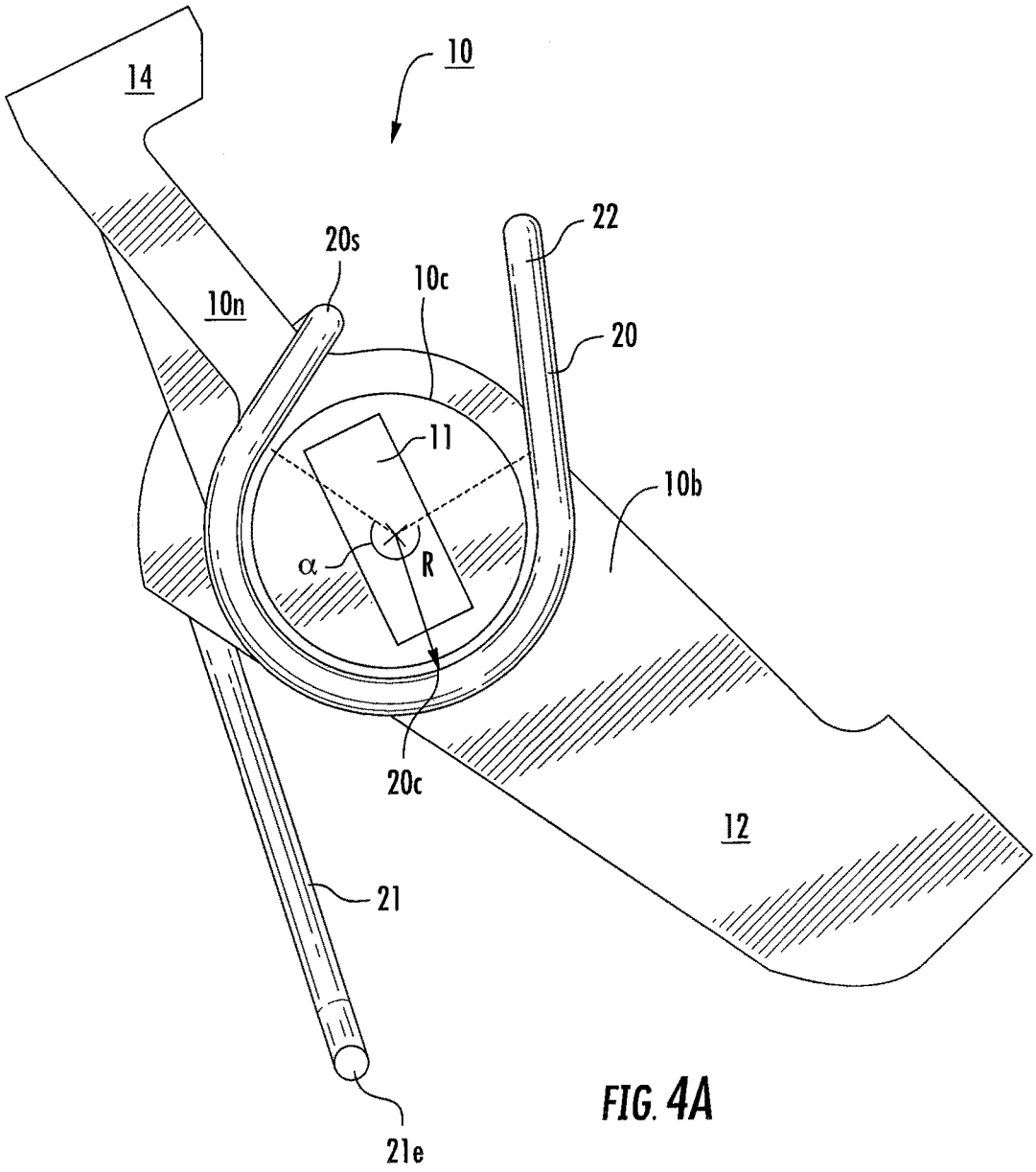
FIG. 4A is a side view of the trip cam shown in FIGS. 2A and 2B.
Figure 4B:
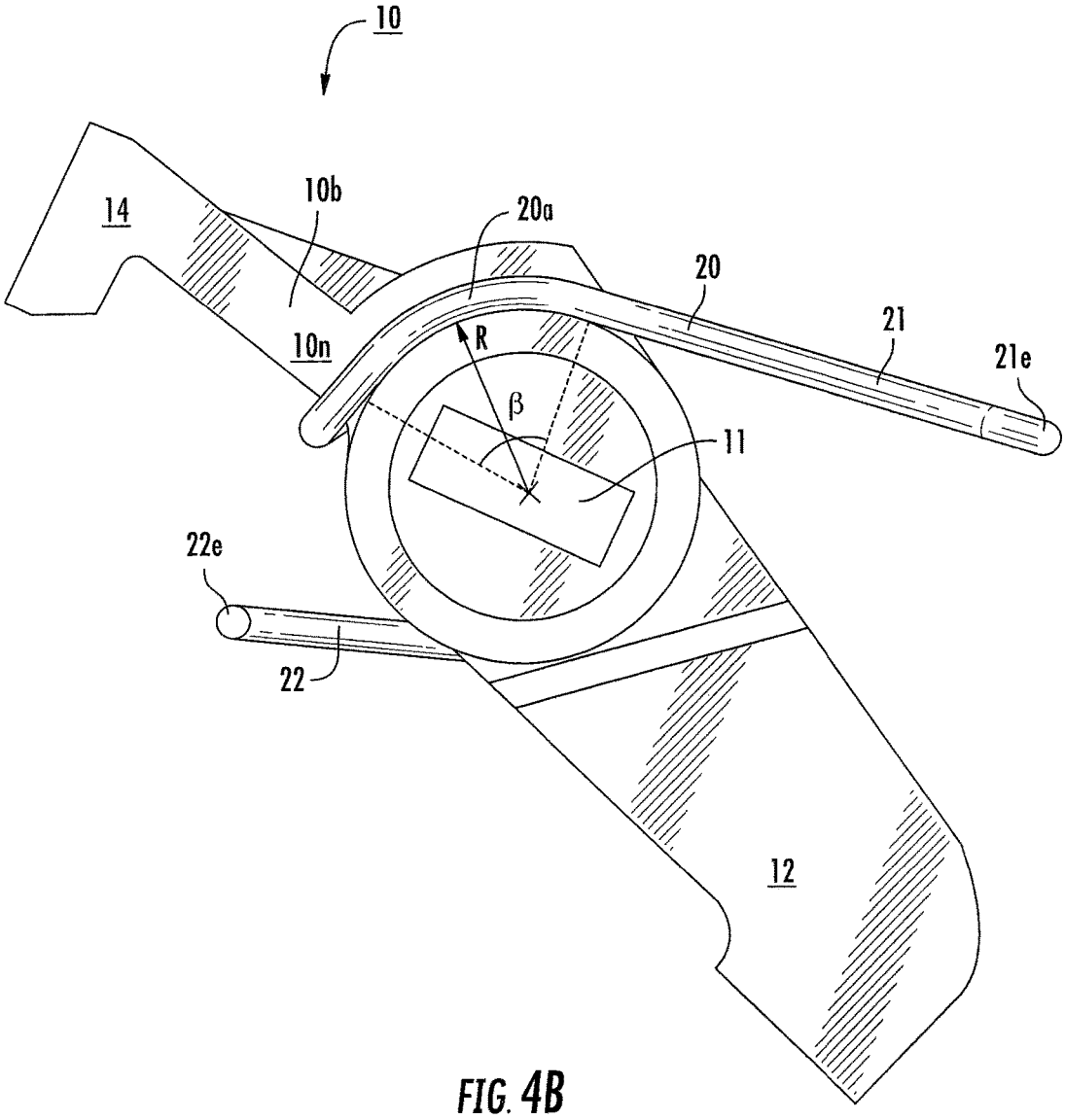
FIG. 4B is an opposing side view of the trip cam shown in FIGS. 2A and 2B.
Figure 5A:
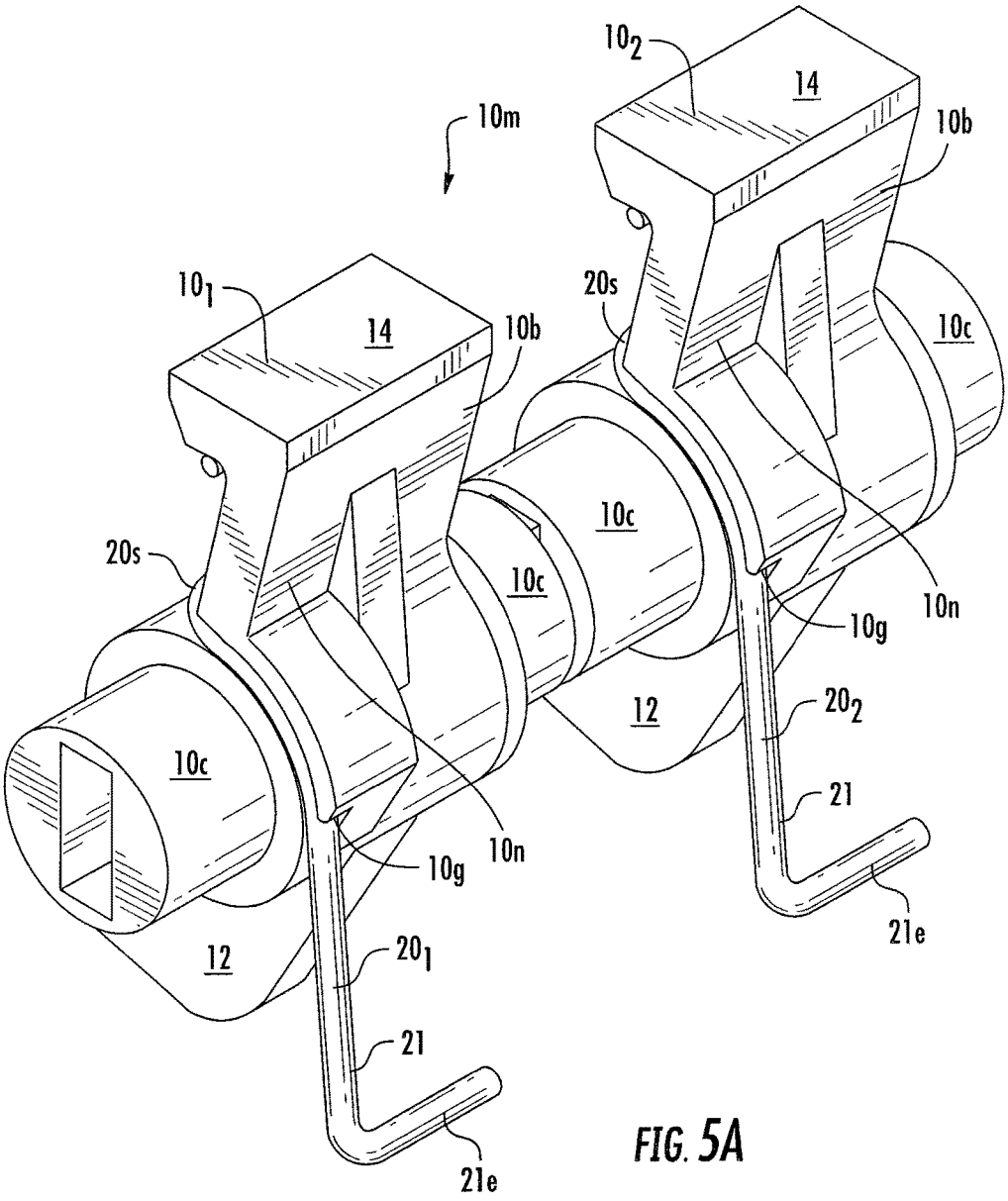
FIG. 5A is a side perspective view of a plurality of attached trip cams according to embodiments of the present invention.
Figure 5B:
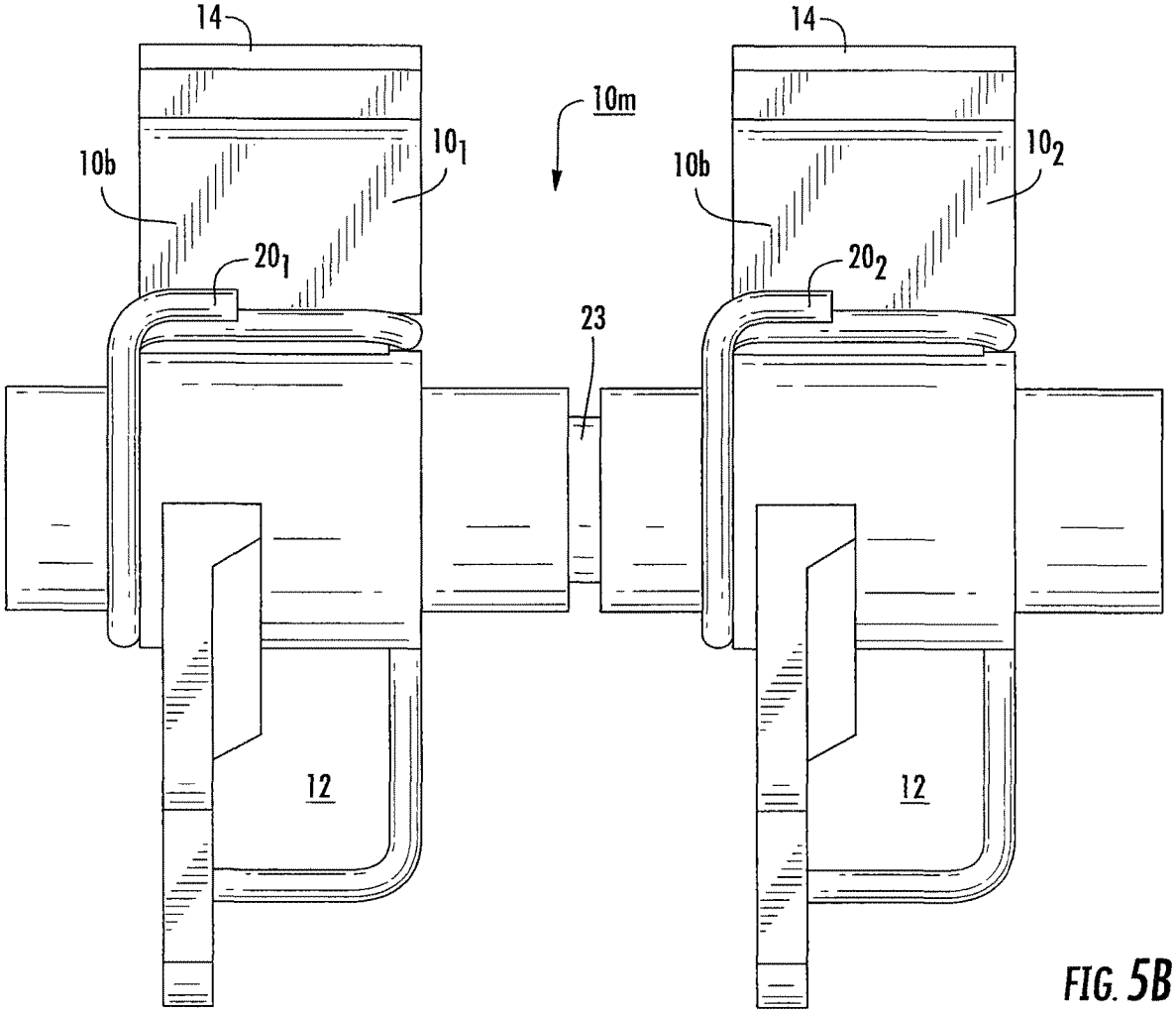
FIG. 5B is front view of the plurality of attached trip cams shown in FIG. 5B.
Figure 6A:
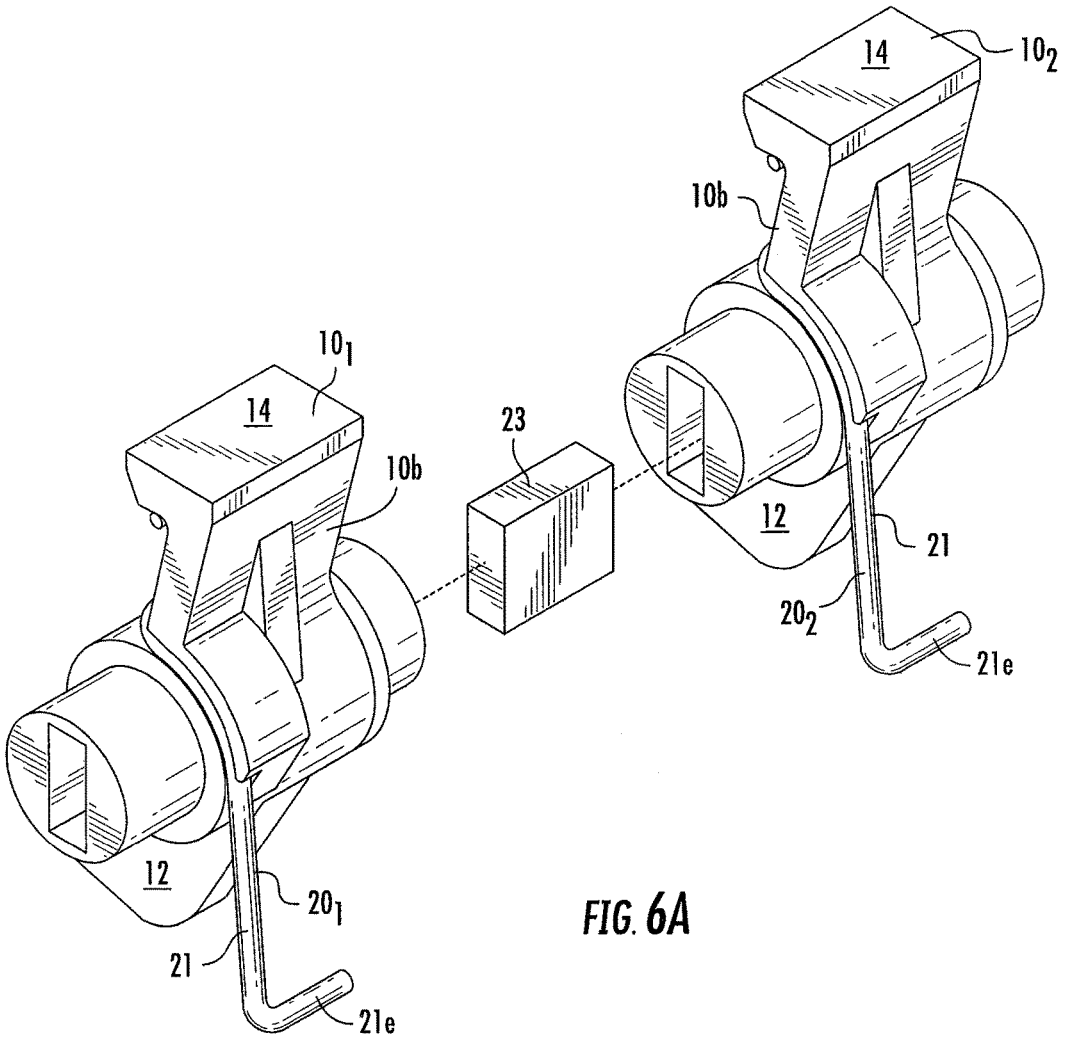
FIG. 6A is an exploded rear perspective view of the attached trip cams according to embodiments of the present invention.
Figure 6B:
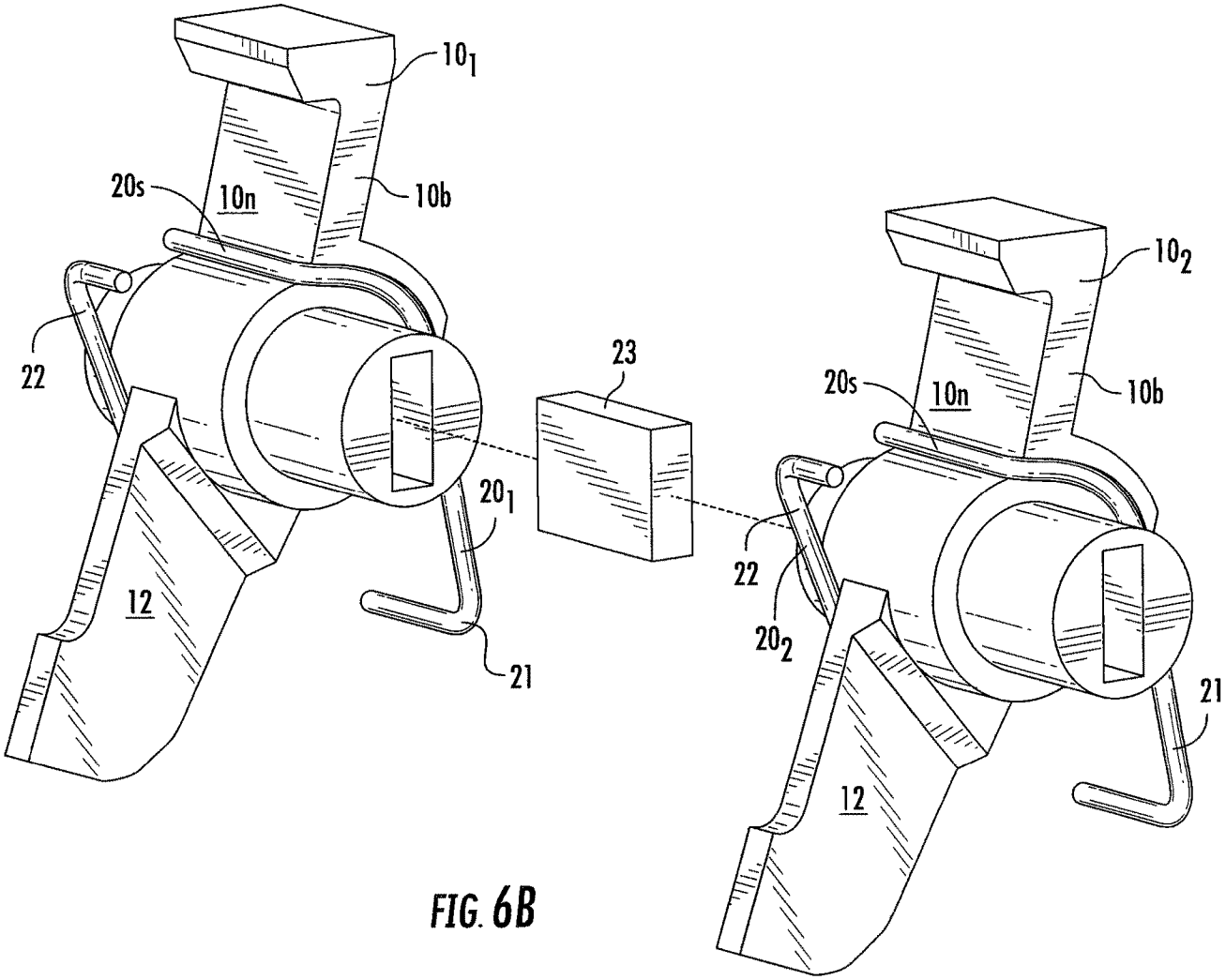
FIG. 6B is an exploded front perspective view of the attachable trip cams according to embodiments of the present invention.

As shown in FIGS. 4A and 4B, the first arc segment 20*a* can extend at an angle β while the second arc segment 20*c* can extend at an angle α and typically α>β. Where a continuous length spring is used for both the arm and leg, 22, 21, respectively, the arm 22 may be a forward segment of a "lasso" or substantially circular shape.

In some embodiments, α is between about 120 degrees to about 270 degrees, more typically between about 180 degrees and 250 degrees, such as about 180 degrees, about 185 degrees, about 190 degrees, about 195 degrees, about 200 degrees, about 200 degrees, about 205 degrees, about 210 degrees, about 215 degrees, about 220 degrees about 225 degrees, about 230 degrees, about 235 degrees, about 240 degrees, about 245 degrees and about 250 degrees.

In some embodiments, β is between about 45 degrees and about 180 degrees, typically between about 70 degrees and about 90 degrees, such as about 70 degrees, about 75 degrees, about 80 degrees, about 85 degrees, or about 90 degrees.

The first arc segment 20*a* can turn and/or bend the leg 21 to extend off one side of the trip cam body 10*b* and the second (larger) arcuate segment 20*c* can turn and/or bend the arm 22 toward an opposing side of the trip cam body 10*b*. The arc segments 20*a*, 20*c* can be configured so that the arm 21 and leg 22 extend outward from circular axially spaced apart end portions 10*c* of the trip cam body 10*b* in directions that are substantially diametrically opposed.

The arc segments 20*a*, 20*c* can have a radius R that corresponds with a radius of the outer diameter of the circular end segments 10*c*.

Figure 8B:
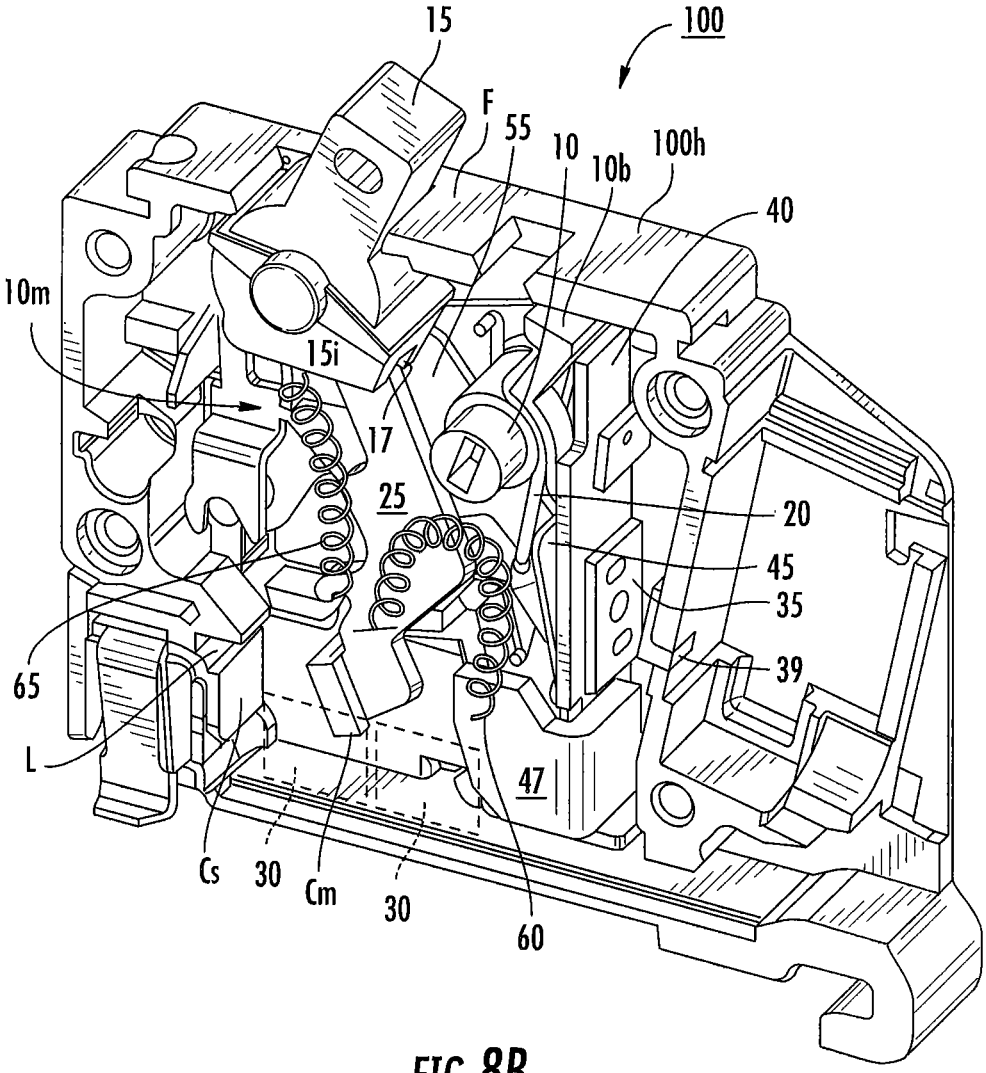
FIG. 8B is a front partial cutaway perspective view of the circuit breaker shown in FIG. 8A illustrating the handle in an "OFF" position according to embodiments of the present invention.
Figure 9A:
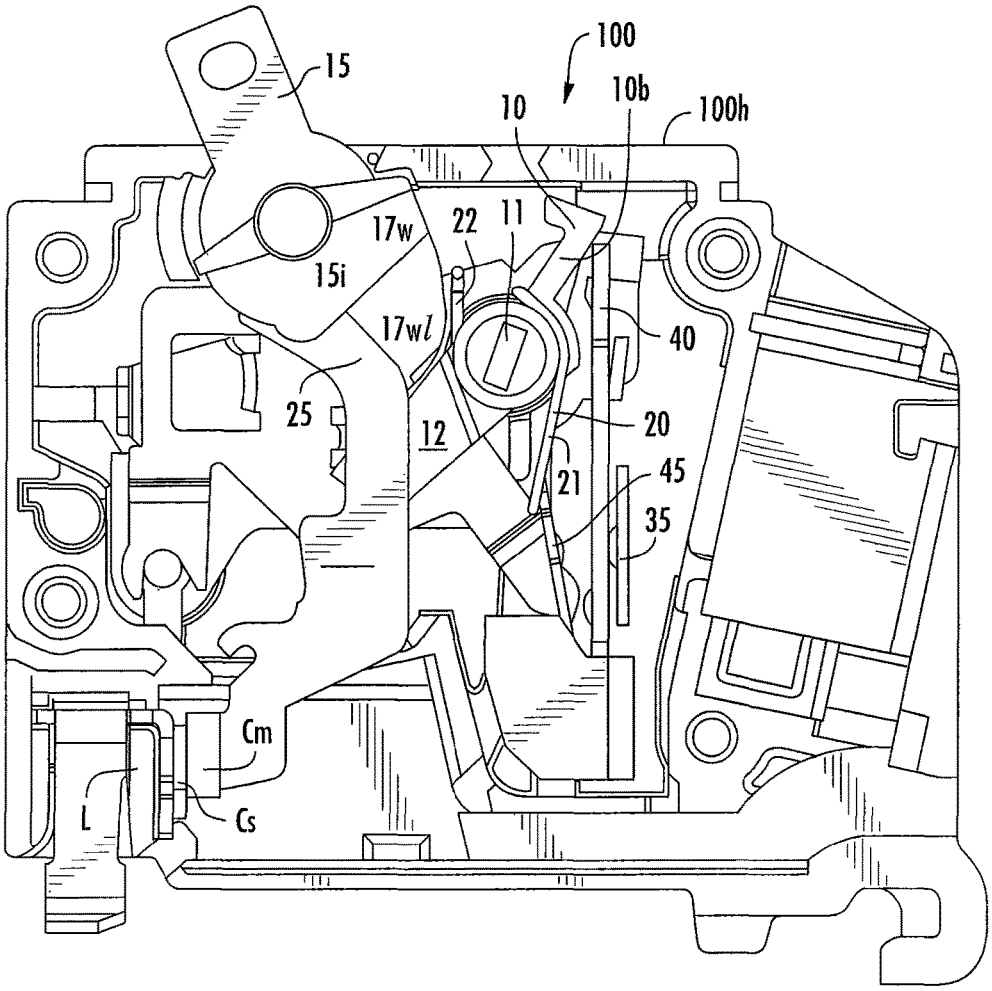
FIG. 9A is a front partial view of an exemplary circuit breaker with the handle in an exemplary "ON" position according to embodiments of the present invention.
Figure 9B:
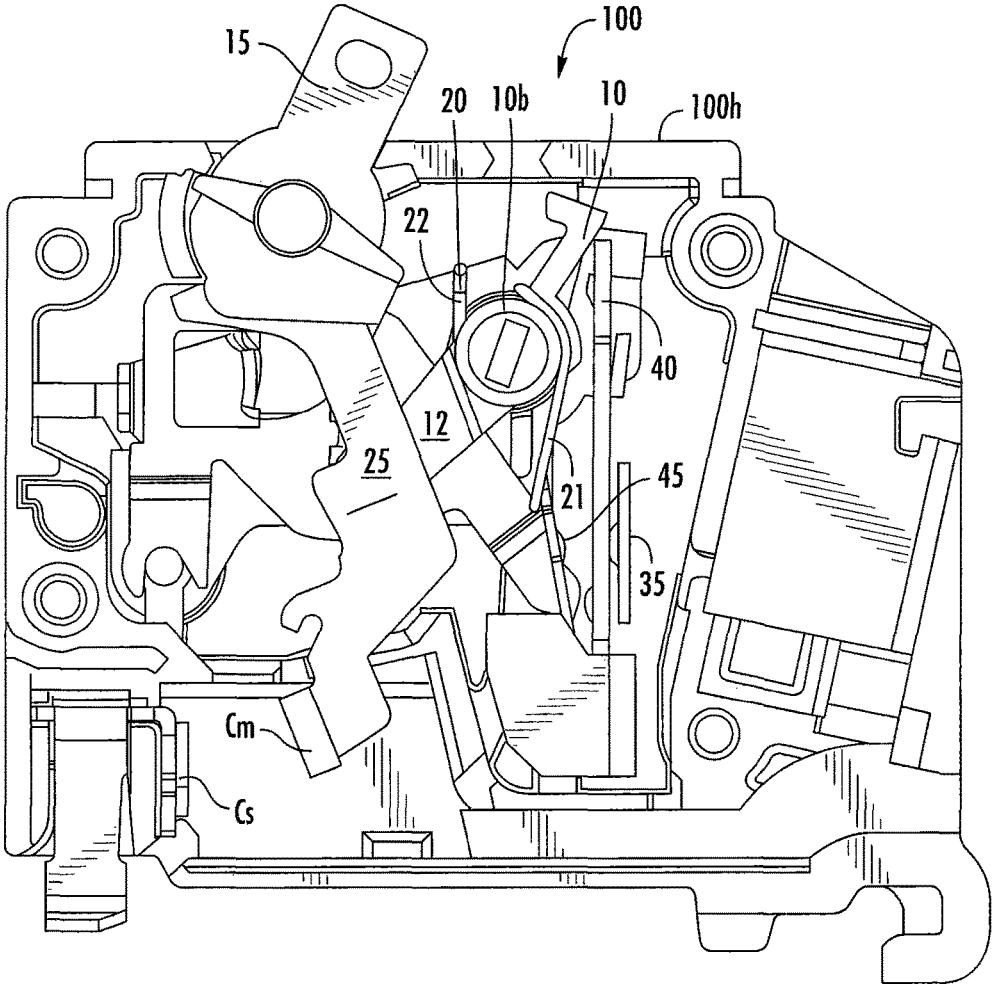
FIG. 9B is a front view of the circuit breaker shown in FIG. 9A illustrating the handle in an "OFF" position according to embodiments of the present invention.
Figure 9C:
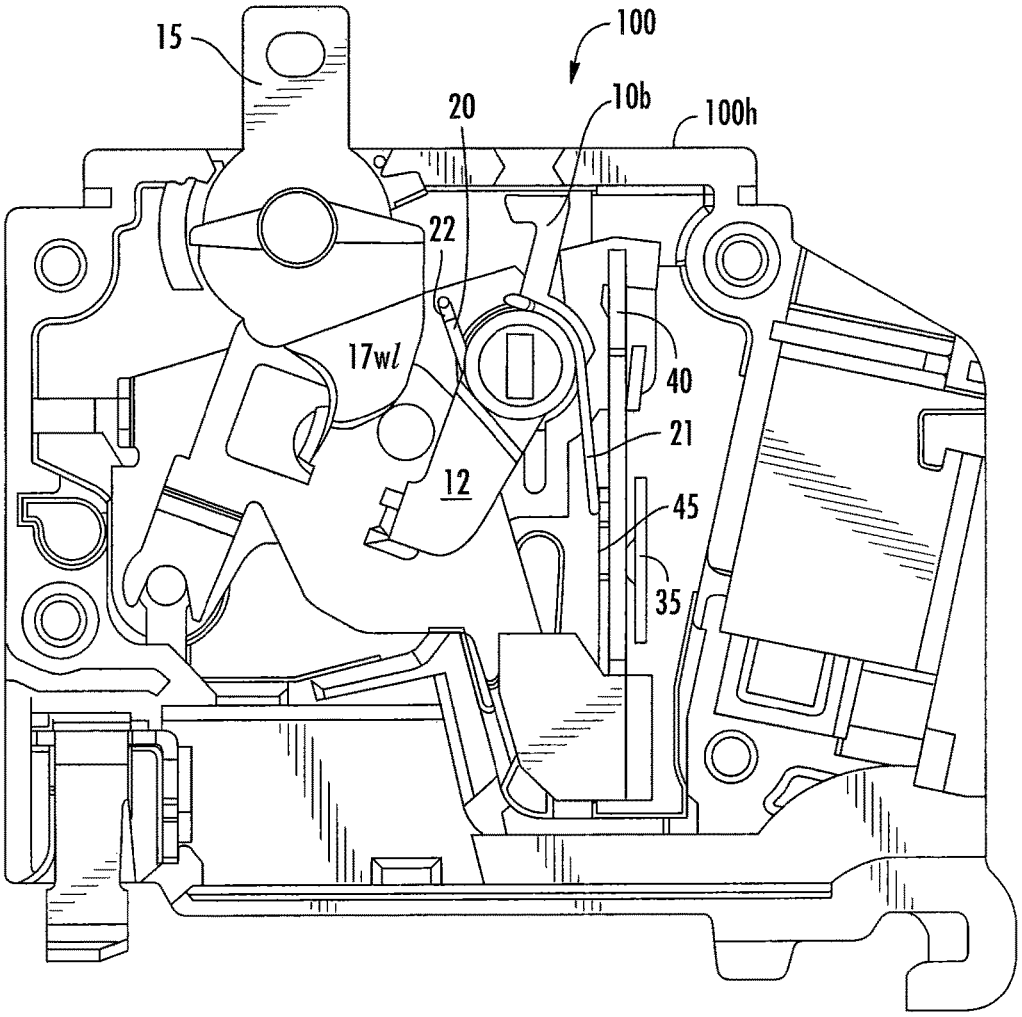
FIG. 9C is a front perspective view of the circuit breaker shown in FIG. 9A illustrating the handle in a "TRIP" position according to embodiments of the present invention.

The trip cam body 10*b* can optionally include an arm 12 that interacts with an operator mechanism 10*m* (FIG. 8B) to force the trip cam body 10*b* to turn when the breaker trips (FIG. 9C).

The trip cam body 10*b* can also have a neck 10*n* that resides between the arm 12 and an opposing planar end portion 14. The planar end portion 14 can be configured to align with a window 100*w* in the housing when the breaker is tripped (FIG. 8C). Other trip cam body configurations may be used that do not require a planar end portion 14 or that may have a different shape of arm 12.

As shown in FIGS. 2B and 3, the trip cam body 10*b* may have features that orient and/or retain the at least one spring 20 in a proper position. The trip cam body can include, for example, a groove 10*g* that holds the first arc segment 20*a* so that the spring is held on the trip body in a desired position/orientation. Other or additional spring body retention features can be used or the spring may have a self-retention shape/size.

The circular end segments 10*c* of the trip cam base 10*b* can include respective slots 11 that slidably receive an insert and/or link 23 for allowing multiple trip cam bodies 10*b* to be attached/linked together (FIGS. 5A, 5B, 6A, 6B).

Figure 7A:
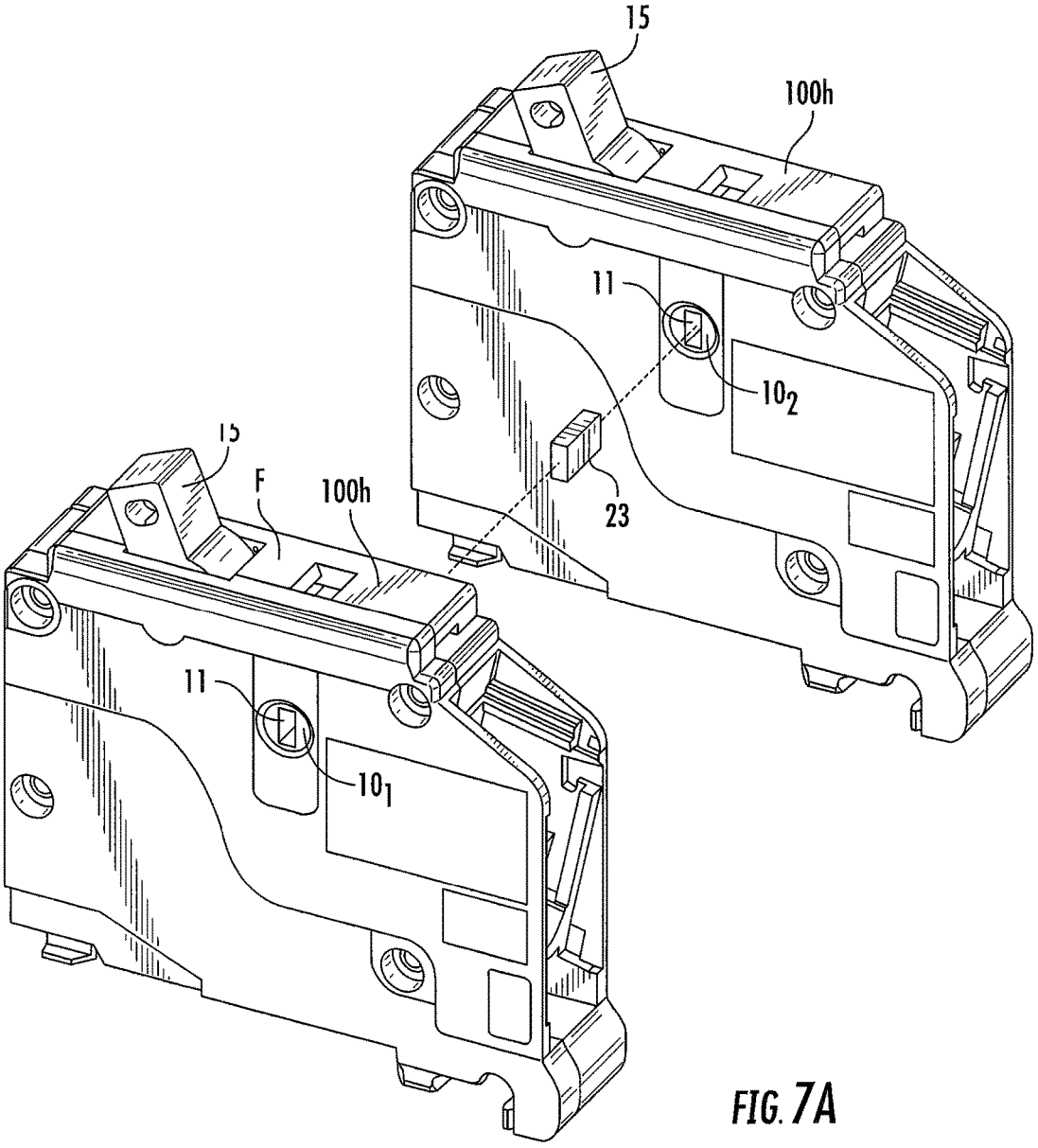
FIG. 7A is an exploded view of two poles of an exemplary breaker according to embodiments of the present invention.
Figure 7B:
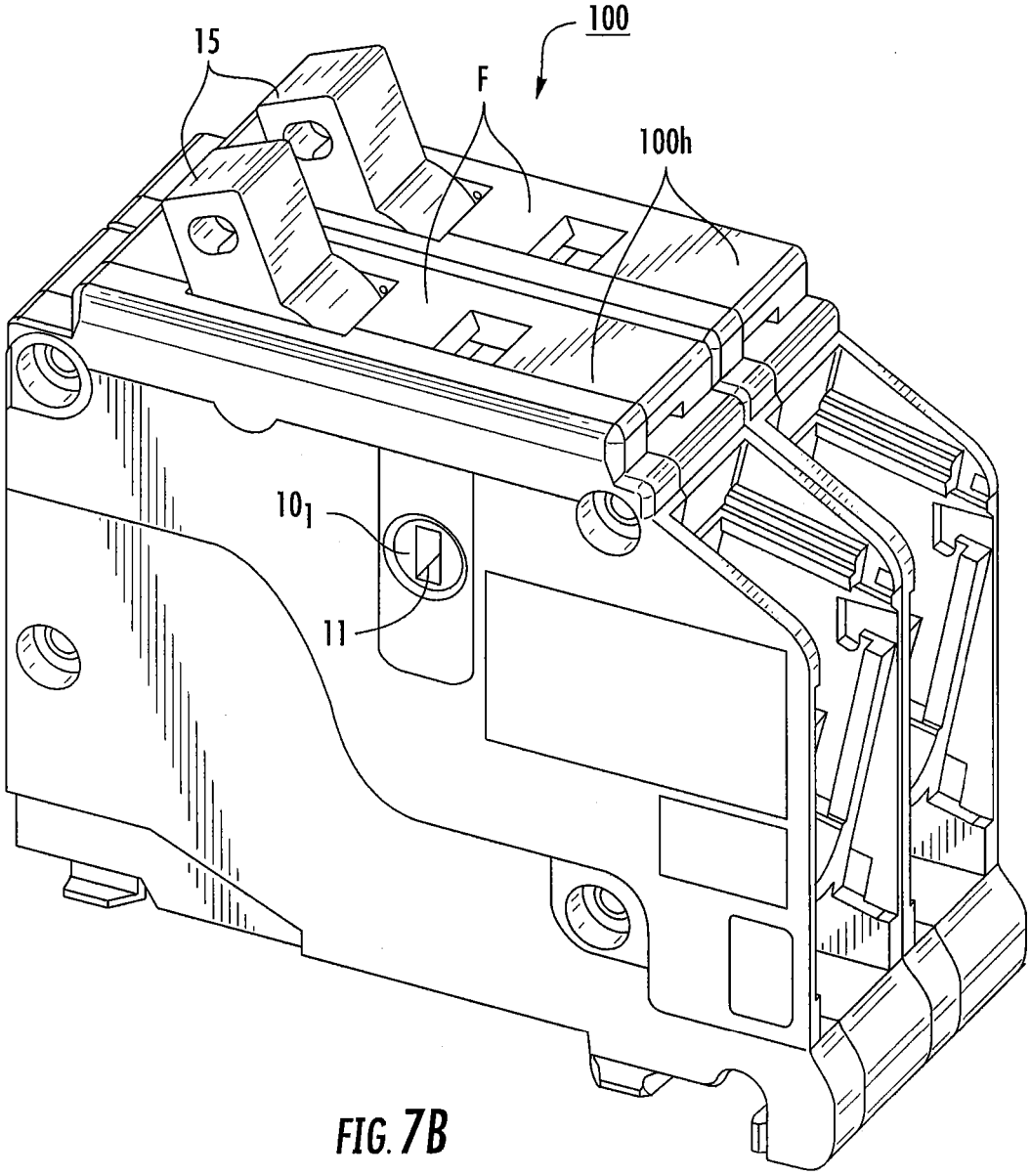
FIG. 7B is an attached view of the two poles of the exemplary breaker shown in FIG. 7A.

FIGS. 7A and 7B illustrate a two-pole breaker 100 with two adjacent housings 100*h*, each holding a handle 15 and cooperating trip cam 10 (e.g., $\mathbf{10}_1$, $\mathbf{10}_2$). The housing 100*h* has a window which provides access to the slot 11 that can hold the link 23 to attach the trip cams $\mathbf{10}_1$, $\mathbf{10}_2$ together. In a typical use orientation, the face F of the breaker 100 is oriented to be vertical and face outward. Although shown as comprising two poles, the circuit breaker 100 can have less or more, e.g., one, two, or three or more poles that may be configured with linked trip cams 10.

It is also noted that the link 23 may be provided as an integral component or feature of a respective trip cam base 10*b* rather than as an insert. Thus, the trip cam bases can be aligned so that a slot of one aligns and connects to an onboard/integral link of another (not shown).

Figure 8A:
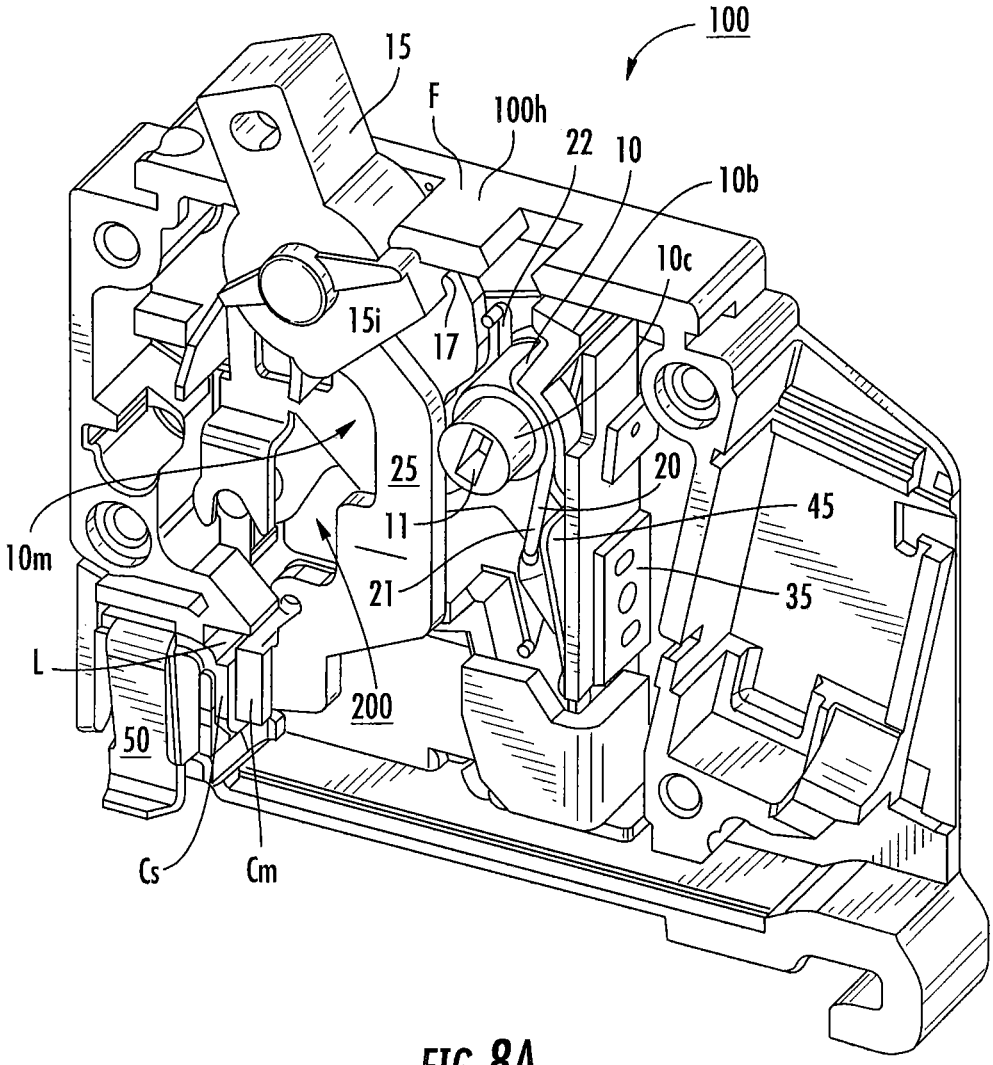
FIG. 8A partial cutaway view of an exemplary circuit breaker with the handle in an exemplary "ON" position according to embodiments of the present invention.
Figure 8C:
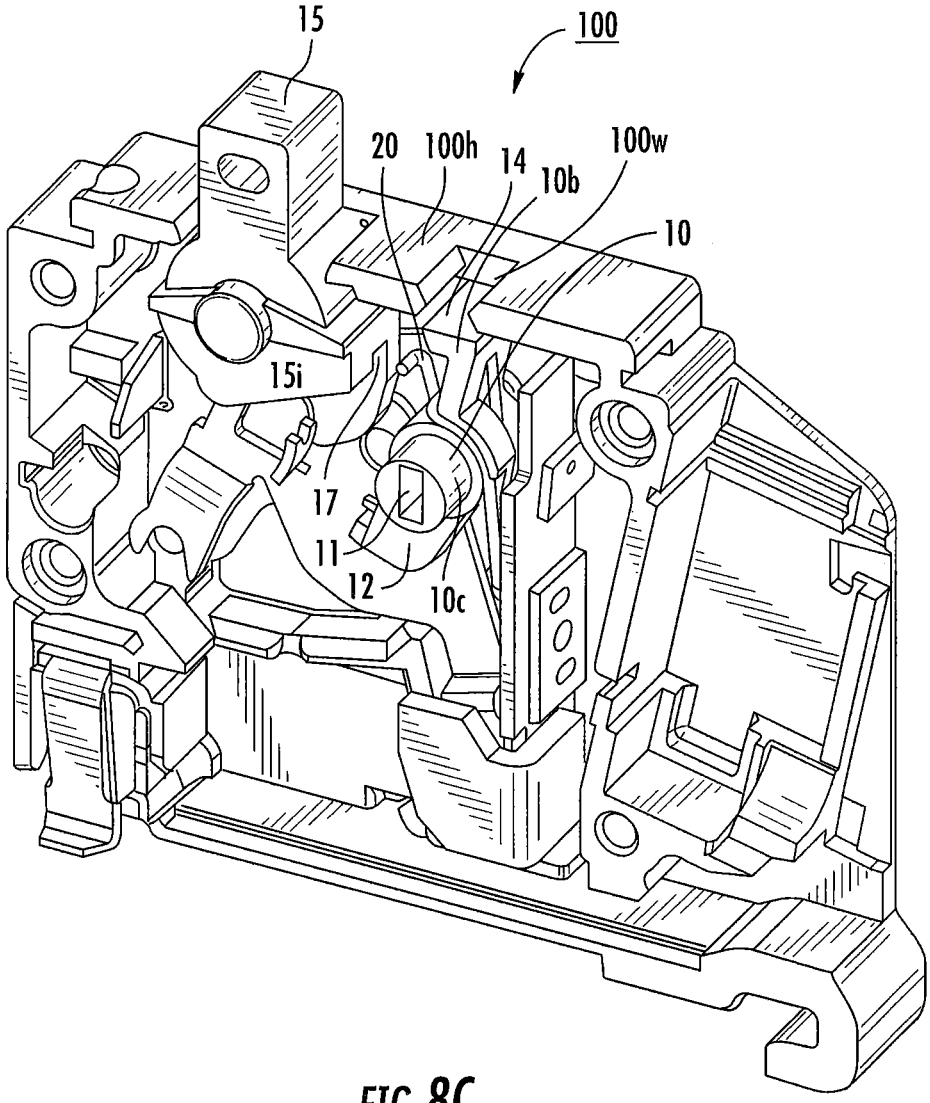
FIG. 8C is a front partial cutaway perspective view of the circuit breaker shown in FIG. 8A illustrating the handle in a "TRIP" position according to embodiments of the present invention.
Figure 8D:
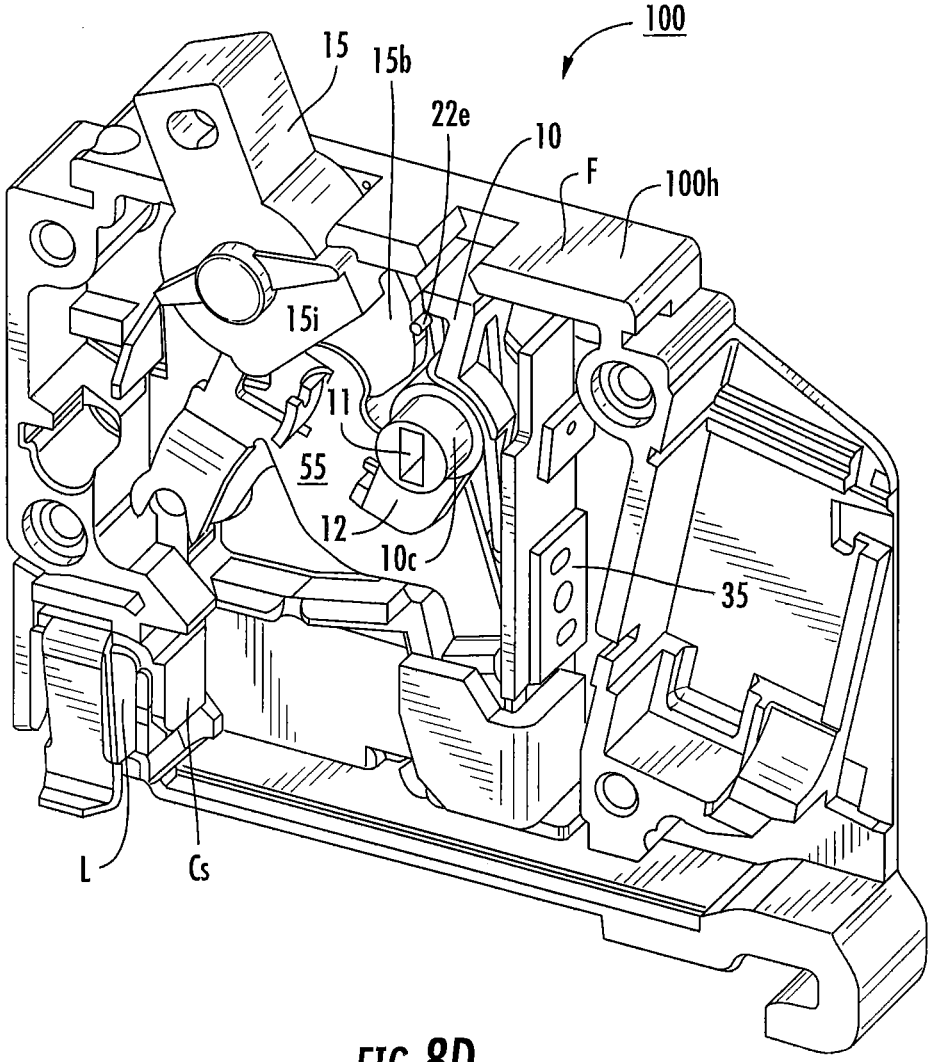
FIG. 8D is a front partial cutaway perspective view of the circuit breaker shown in FIG. 8C illustrating the handle in a "TRIP" handle bump position according to embodiments of the present invention.

FIGS. 8A-8D, 9A-9D and 10 illustrate an exemplary components of a circuit breaker 100. FIGS. 8A, 8B, 9A and 9B show a moving contact arm 25 in the housing 100*h* under the handle 15 (in the orientation shown). FIG. 8B also illustrates (in schematic) the arc chutes 30, the shunt 60 and the mechanism spring 65 not shown in the other figures. FIGS. 8C, 8D, 9C, 9D and 10 omit the moving contact arm 25 for ease of illustration of other components.

Figure 9D:
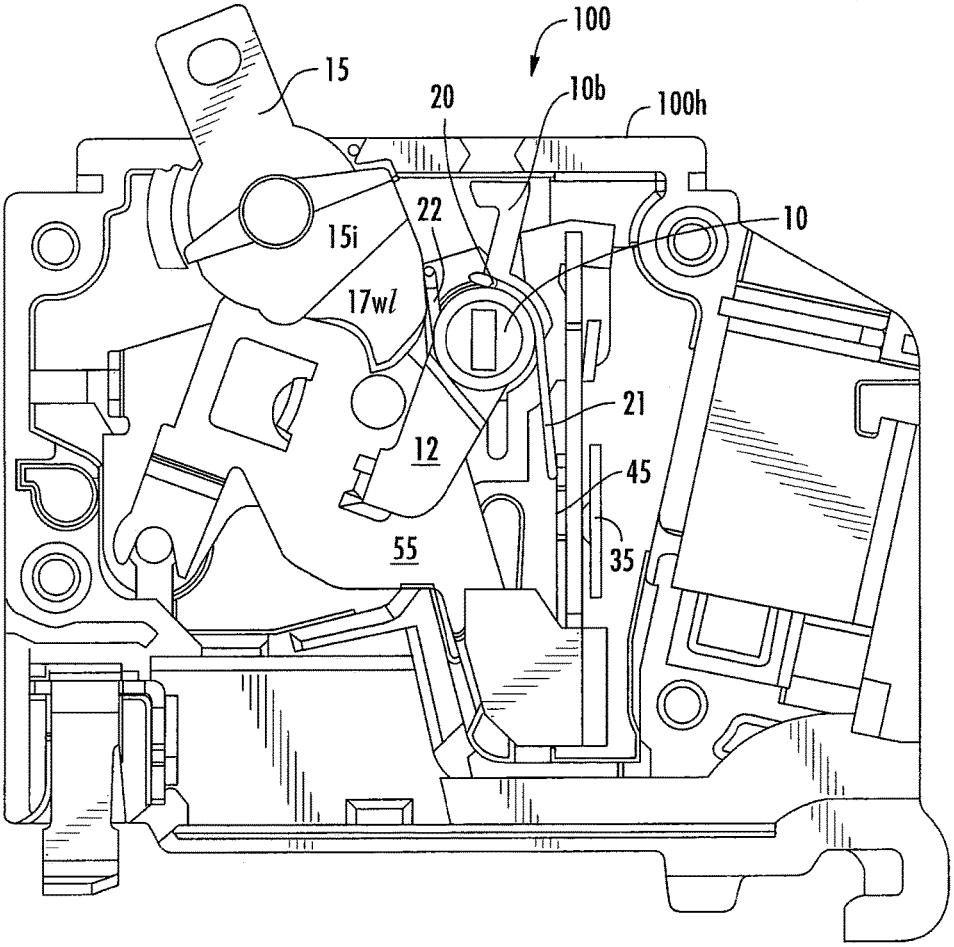
FIG. 9D is a front view of the circuit breaker shown in FIG. 9C illustrating the handle in a "TRIP" handle bump position according to embodiments of the present invention.

FIGS. 8A and 9A illustrate an exemplary handle 15, arm 25 and trip cam 10 with an orientation in an ON position. FIGS. 8B and 9B illustrate an exemplary orientation in an OFF position. FIGS. 8C, 9C illustrate an exemplary orientation in a TRIP position. FIGS. 8D and 9D illustrate an exemplary orientation in a TRIP handle "bump" position.

As is well known, the circuit breaker 10 includes at least one arc chamber 200 which may optionally have at least one arc chute 30 with arc plates (FIG. 8B), an operator mechanism 10*m* (FIGS. 8A,8B) with the arm 25 holding a contact Cm (e.g., a moving contact attached to the "contact arm") and a stationary contact Cs proximate a line terminal L. The arm 25 arm is conductive, typically non-ferromagnetic metal such as, but not limited to, copper. Not all circuit breakers require or use arc plates as is known to those of skill in the art.

As shown in FIGS. 8A-8D and 9A-9D, the handle 15 can be pivotably attached 15*p* to the circuit breaker 100 so as to be able to pivot/rotate between the operative positions. The trip cam 10 can reside adjacent the handle 15 and arm 25. The leg 21 of the spring 20 of the trip cam 10 resides proximate the armature 45 as discussed above to interact with the armature as the cam is moved in a defined direction. The arm 22 (where used) can extend beyond the circular segments 10*c* of the trip cam body 10*b* and reside to be able to contact a portion of the handle 15 (FIGS. 8D, 9D) to bump and/or push the handle 15 into the trip position, if needed.

The handle 15 can include an external portion 15*e* which can comprise a user actuator or input such as a lever, thumb or finger wheel or other suitable configuration.

The handle 15 can have an internal portion 15*i* with an arm receiving channel 17 that remains inside the housing 100*h* (8A, 8B). The arm receiving channel 17 can receive the first (shown as the upper) end portion of the arm 25 and allows the arm 25 to move right to left through ON, OFF, TRIP positions.

Referring again to FIGS. 8A-8D, 9A-9D, the circuit breaker 100 can also include one or more of a magnet 35, a load terminal 39 (shown schematically in FIG. 8B), a bimetal member 40, a shunt bracket 47, a spring clip 50, a cradle 55 and frame 57. The circuit breaker 10 can have alternate configurations and components.

FIG. 8B schematically illustrates a shunt 60 attached to the arm 25 and shunt bracket 47. The shunt 60 can be resilient and/or flexible. FIG. 8B also schematically illustrates a mechanism spring 65 which is part of the operator mechanism 10*m*, as is well known to those of skill in the art.

FIGS. 8A-8C and 9A-9C illustrate exemplary handle 15 and trip cam 10 positions for different operative positions, ON, OFF and TRIP. The movements can be over a desired angulation, typically between about 45 degrees to about 90 degrees, more typically about 90 degrees between the OFF and ON positions with the TRIP position between the OFF and ON. In the ON position, the arm 25 places the moveable contact Cm in abutting contact with the stationary contact Cs (FIG. 8A, 9A). In the OFF position, the arm 25 rotates to move the moveable contact Cm away from the stationary contact Cs (FIG. 8B, 9B). In the TRIP position, the arm 25 also positions the moveable contact Cm away from the stationary contact Cs, typically a distance greater than the spaced apart distance of the two contacts Cs, Cm in the "OFF" position.

In some embodiments, the first (shown as the upper) end of the arm 25 is able to move relative to the handle 15 in the arm receiving channel 17 of the handle. Compare the position of the upper end of the arm 25 with the handle 15 in FIGS. 9A and 9B, for example.

Figure 10:
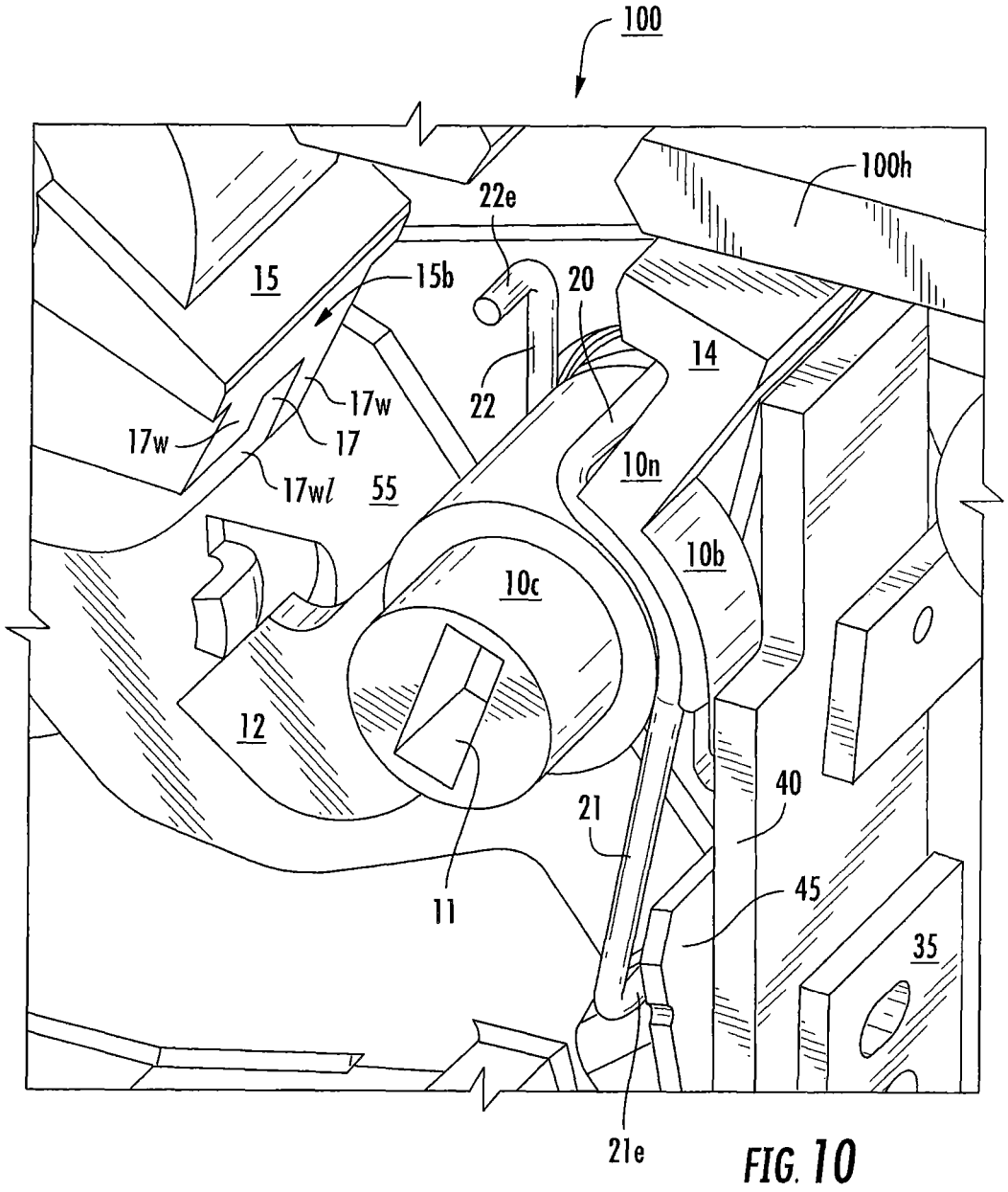
FIG. 10 is a greatly enlarged partial front perspective view of the circuit breaker with the trip cam and cradle according to embodiments of the present invention.

Referring to FIG. 10, in some embodiments, the handle arm channel 17 can reside between a pair of spaced apart sidewalls 17*w*, one of which can be longer than the other, 17*wl*. The longer channel 17*wl* can extend down a distance that is between about 1.5× to about 10 times the length of the shorter sidewall, typically between about 2× to about 5×, such as about 3×. The arm 22 of the trip cam 10 can be aligned with the bottom portion of the handle 15*b*, typically with the long sidewall 17*wl* to be able to contact the handle 15 and push the handle 15 to the trip position (FIG. 8D, 9D).

Upon a tripping event, the pivoting/rotating cradle 55 will realign the mechanism pivot points and spring such to produce motivation for the handle to move from the ON to TRIPPED position. Simultaneously, the rotating cradle 55 will interact with arm 12 of trip cam base to force cam rotation. The rotation of trip cam spring leg 22 accompanies the trip cam rotation, resulting in an additional force to be applied to the handle to assist in its movement to the TRIPPED position. Also, rotation of the trip cam can be configured to produce a likewise rotation of all adjacent cams that are linked, resulting in trip cam spring leg 21 of the linked poles to engage the armature and forcibly also trip these mechanisms.

In some embodiments, the circuit breakers 100 can be DC circuit breakers, AC circuit breakers, or both AC and DC circuit breakers.

The circuit breakers 100 can be rated for voltages between about 1 V to about 5000 volts (V) DC and/or may have current ratings from about 15 to about 2,500 Amperes (A). However, it is contemplated that the circuit breakers 100 and components thereof can be used for any voltage, current ranges and are not limited to any particular application as the circuit breakers can be used for a broad range of different uses.

The circuit breakers 100 can be a bi-directional direct current (DC) molded case circuit breaker (MCCB). See, e.g., U.S. Pat. Nos. 5,131,504 and 8,222,983, the contents of which are hereby incorporated by reference as if recited in full herein. The DC MCCBs can be suitable for many uses such as data center, photovoltaic, and electric vehicle applications.

The circuit breaker 100 may be particularly suitable for residential MCBs with 70 Amp and above ratings.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A circuit breaker comprising:

a housing;

a pivotable handle held by the housing;

a moving contact arm held in the housing in communication with the handle;

an armature held in the housing;

a trip cam held in the housing, the trip cam comprising at least one spring with at least one segment that extends outward a distance from an axis of rotation of the trip cam to contact the armature; and a cradle in the housing in communication with the handle and the trip cam, wherein the at least one spring comprises a first arcuate segment that extends a first angular distance before merging into the at least one segment that extends outward a distance to contact the armature, wherein the at least one spring comprises a second arcuate segment that is spaced apart from the first arcuate segment and that extends a second angular distance, and wherein the second angular distance is greater than the first angular distance.

2. The circuit breaker of claim 1, wherein the trip cam comprises a trip cam base, and wherein the at least one spring is held by the trip cam base and the at least one segment comprises a leg that extends outward from the trip cam base to contact the armature.

3. The circuit breaker of claim 2, wherein the trip cam base has a first circular end segment, and wherein the leg has a primary portion that angles out away from the first circular end segment and merges into a free end portion that contacts the armature.

4. The circuit breaker of claim 2, wherein the leg has a free end, wherein the leg can flex side-to-side and/or front-to-back relative to the trip cam base to thereby accommodate tolerance variations.

5. The circuit breaker of claim 2, wherein the leg that has a primary portion that is straight and merges into a free end portion that extends substantially orthogonal to the primary portion of the leg, and wherein the leg is configured to be able to flex side-to-side and/or front-to-back relative to the trip cam base to engage the armature in the circuit breaker.

6. The circuit breaker of claim 1, wherein the trip cam comprises a trip earn base, wherein the at least one spring is held by the trip cam base, wherein the trip cam base has opposing circular end segments separated by a neck segment, wherein the second arcuate segment of at least one spring merges into an arm that extends away from the neck segment, wherein the arm cooperates with an operator mechanism in the housing to force the trip cam base to turn when the breaker trips, and wherein at least one of the circular end segments of the trip cam base comprises an open slot sized and configured to receive a link member for linking another trip cam of an adjacent pole of the circuit breaker.

7. The circuit breaker of claim 1, wherein the housing is configured as a plurality of adjacent housings forming multiple poles of the circuit breaker, each having a respective handle, moving contact arm and trip cam, wherein the trip cams each have opposing circular end segments and the at least one spring, and wherein adjacent circular end segments of neighboring housings are mechanically linked together so that when one pole of the circuit breaker trips a respective trip cam of that pole, the trip cam of that pole forces other linked trip cams to rotate so that all poles trip to thereby have a common trip function.

8. The circuit breaker of claim 1, wherein the trip cam has a trip cam base with laterally spaced apart opposing circular end segments, wherein at least one of the circular end segments comprises an open slot sized and configured to receive a link member for linking another trip cam of an adjacent pole of the circuit breaker, and wherein at least one of the circular end segments comprises a groove in an outer surface thereof that holds a segment of the at least one spring in position.

9. A circuit breaker comprising:

a housing;

a pivotable handle held by the housing;

a moving contact arm held in the housing in communication with the handle;

an armature held in the housing;

a trip cam comprising a trip cam base held in the housing;

a cradle in the housing in communication with the handle and the trip cam; and at least one spring held by the trip cam base comprising a leg that extends outward a distance from an outer surface of the trip cam base and is configured to contact the armature, wherein the trip cam base has opposing circular end segments separated by a neck segment, and wherein the at least one spring has a straight segment extending across the neck segment and at least one arcuate segment that extends about at least a portion of one of the circular end segments before merging into the leg.

10. A circuit breaker comprising:

a housing;

a pivotable handle held by the housing;

a moving contact arm held in the housing in communication with the handle;

an armature held in the housing;

a trip cam held in the housing, the trip cam comprising at least one spring with a leg segment that extends outward a distance from an axis of rotation of the trip cam to contact the armature; and a cradle in the housing in communication with the handle and the trip cam, wherein the at least one spring comprises an arm that is laterally spaced apart from the leg, wherein the arm extends outward a distance from the axis of rotation of the trip cam, wherein the arm resides closer to the handle than the leg, and wherein the leg has a longer length than the arm.

11. The circuit breaker of claim 10, wherein the at least one spring comprises a first arcuate segment that extends about a first circular end segment of a trip cam base a first angular distance, wherein the at least one spring further comprises a second arcuate segment that extends about a second axially spaced apart circular end segment of the trip cam base a second angular distance, and wherein the second angular distance is greater than the first angular distance.

12. A circuit breaker comprising:

a housing;

a pivotable handle held by the housing;

a moving contact arm held in the housing in communication with the handle;

an armature held in the housing;

a trip cam held in the housing, the trip cam comprising at least one spring with a leg segment that extends outward a distance from an axis of rotation of the trip cam to contact the armature; and a cradle in the housing in communication with the handle and the trip cam, wherein the leg segment has a free end, wherein the leg segment can flex side-to-side and/or front-to-back relative to the trip cam base to thereby accommodate tolerance variations, wherein the at least one spring is a single, continuous length wire with a preformed shape comprising a straight segment with opposing first and second ends, the first end of the straight segment merging into a first arcuate segment that merges into the leg segment, the second end of the straight segment merging into a second arcuate segment that merges into an arm segment.

13. A trip cam for a circuit breaker, comprising:

a trip cam base having a neck separating a first end portion and a second end portion, the second end portion defining an arm that is sized and configured to cooperate with an operator mechanism to force the trip cam to turn when a circuit breaker trips; and at least one spring held on the trip cam base comprising a leg segment that extends off the trip cam base a distance sufficient to contact an armature in a circuit breaker, wherein the trip cam base has opposing first and second circular end segments separated by a neck segment, and wherein the at least one spring has a straight segment extending across the neck segment and at least one arcuate segment that extends about at least a portion of the first circular end segment before merging into the leg segment.

14. The trip cam of claim 13, wherein the leg segment has a primary portion that is straight that merges into a free end portion that extends substantially orthogonal to the primary portion of the leg segment, and wherein the leg segment is configured to be able to flex side-to-side and/or front-to-back relative to the trip cam base to engage an armature in the circuit breaker.

15. The trip cam of claim 13, wherein at least one of the first and second circular end segments comprises an open slot sized and configured to receive a link member for linking another trip cam of an adjacent pole of the circuit breaker.

16. The trip cam of claim 13, wherein the at least one spring is a single, continuous length wire with a preformed shape comprising the straight segment having opposing first and second ends, the first end of the straight segment merging into a first arcuate segment as the at least one arcuate segment that merges into the leg segment, the second end of the straight segment merging into a second arcuate segment that merges into an arm.

17. The trip earn of claim 13, wherein the at least one spring comprises a first arcuate segment as the at least one arcuate segment that extends about the first circular end segment of the trip cam base a first angular distance, wherein the at least one spring comprises a second arcuate segment that is spaced apart from the first arcuate segment and that extends about the second circular end segment of the trip cam base a second angular distance, and wherein the second angular distance is greater than the first angular distance.

18. A trip cam for a circuit breaker, comprising:

a trip cam base having a neck separating opposing circular first and second end segments; and at least one spring held on the trip cam base comprising a leg segment that extends off the trip cam base a distance sufficient to contact an armature in a circuit breaker, wherein the at least one spring further comprises an arm that is spaced apart from the leg segment to reside adjacent the first end segment of the trip cam base and the leg segment resides adjacent the second end segment of the trip cam base, and wherein the leg segment has a longer length than the arm of the at least one spring.

19. A method of moving components of a circuit breaker upon a tripping event, comprising:

upon a tripping event:

automatically rotating a cradle to realign a mechanism pivot point to move a handle from an ON to a TRIPPED position and, simultaneously, the rotating cradle interacts with an arm of a trip cam base to force trip cam rotation, wherein (a) rotation of a trip cam spring leg in response to the forced trip cam rotation applies an additional force on the handle to assist in movement of the handle to the TRIPPED position and (b) rotation of the trip cam produces a likewise rotation of all adjacent trip cams that are linked so that respective trip cam spring legs of linked poles engage a respective armature and forcibly also trip corresponding mechanisms, wherein the trip cam spring legs extend from respective single, continuous length wires with a preformed shape comprising a straight segment with opposing first and second ends, the first end of the straight segment merging into a first arcuate segment that merges into the spring leg, the second end of the straight segment merging into a second arcuate segment that merges into an arm.

* * * * *